US011024162B2

(12) United States Patent
Zavesky et al.

(10) Patent No.: US 11,024,162 B2
(45) Date of Patent: Jun. 1, 2021

(54) TRAFFIC MANAGEMENT SYSTEM

(71) Applicant: AT&T Intellectual Property I, L.P., Atlanta, GA (US)

(72) Inventors: Eric Zavesky, Austin, TX (US); Jason Decuir, Cedar Park, TX (US); Robert David Gratz, Lockhart, TX (US); Martin Patrick McEnroe, Plano, TX (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 5 days.

(21) Appl. No.: 16/540,982

(22) Filed: Aug. 14, 2019

(65) Prior Publication Data

US 2021/0049904 A1 Feb. 18, 2021

(51) Int. Cl.

| | |
|---|---|
| ***G08G 1/017*** | (2006.01) |
| ***G08G 1/01*** | (2006.01) |
| ***G08G 1/0962*** | (2006.01) |

(52) U.S. Cl.

CPC ..... *G08G 1/0133* (2013.01); *G08G 1/0116* (2013.01); *G08G 1/0962* (2013.01)

(58) Field of Classification Search

None

See application file for complete search history.

(56) References Cited

U.S. PATENT DOCUMENTS

| | | | |
|---|---|---|---|
| 9,475,422 | B2 | 10/2016 | Hillis et al. |
| 9,552,735 | B2 | 1/2017 | Pilutti et al. |
| 9,586,585 | B2 | 3/2017 | Delp et al. |

(Continued)

FOREIGN PATENT DOCUMENTS

| | | | |
|---|---|---|---|
| DE | 102013226336 | A1 | 6/2015 |
| DE | 102016113913 | A1 | 2/2018 |

(Continued)

OTHER PUBLICATIONS

Richard Mason, Jim Radford, Deepak Kumar Robert Waters, Brian Fulkerson, Eagle Jones, David Caldwell, Jason Meltzer, Yaniv Alon, Amnon Shashua, Hiroshi Hattori, Emilio Frazzoli, and Stefano Soatto, "The Golem Group/University of California at Los Angeles Autonomous Ground Vehicle in the DARPA Grand Challenge," Received Dec. 13, 2005; accepted Jun. 12, 2006, 27 Pages, The Golem Group, Santa Monica, California, Journal of Field Robotics DOI 10.1002/rob.

(Continued)

*Primary Examiner* — Brent Swarthout

(74) *Attorney, Agent, or Firm* — Amin, Turocy & Watson, LLP

(57) ABSTRACT

A traffic management system that manages policy agreements between operators and visual indicator devices receives first sensor data from a physical environment. The traffic management system computationally processes the first sensor data to identify a first visual indication in the sensor data and determines that the first visual indication is associated with first policy agreement. The traffic management system then determines, based on the first sensor data, that a first visual indicator system that provided the first visual indication is violating a first policy included in the first policy agreement and, in response, provides a policy violation notification that the first visual indicator system is violating the first policy.

20 Claims, 9 Drawing Sheets

(56) References Cited

U.S. PATENT DOCUMENTS

| | | | | |
|---|---|---|---|---|
| 9,589,464 | B2 | 3/2017 | Rovik et al. | |
| 9,804,599 | B2 | 10/2017 | Kentley-Klay et al. | |
| 9,855,890 | B2 | 1/2018 | James et al. | |
| 9,881,503 | B1 | 1/2018 | Goldman-Shenhar et al. | |
| 9,953,538 | B1 | 4/2018 | Matthiesen et al. | |
| 9,959,768 | B2 | 5/2018 | Leppanen et al. | |
| 9,969,320 | B2 | 5/2018 | Kim et al. | |
| 9,969,326 | B2 | 5/2018 | Ross et al. | |
| 10,077,007 | B2 | 9/2018 | Meyhofer et al. | |
| 10,139,818 | B2 | 11/2018 | Tao et al. | |
| 2001/0056544 | A1* | 12/2001 | Walker | B60R 25/042 726/2 |
| 2015/0268665 | A1 | 9/2015 | Ludwick et al. | |
| 2015/0332563 | A1* | 11/2015 | Davis | G08B 5/006 342/66 |
| 2016/0231746 | A1 | 8/2016 | Hazelton et al. | |
| 2017/0060130 | A1 | 3/2017 | Kim et al. | |
| 2018/0018869 | A1* | 1/2018 | Ahmad | G05D 1/0246 |
| 2018/0082588 | A1 | 3/2018 | Hoffman, Jr. et al. | |
| 2018/0136654 | A1 | 5/2018 | Kentley-Klay et al. | |
| 2018/0173237 | A1 | 6/2018 | Reiley et al. | |
| 2018/0276986 | A1 | 9/2018 | Delp | |
| 2018/0326982 | A1 | 11/2018 | Paris et al. | |
| 2019/0066492 | A1* | 2/2019 | Nijhuis | G08G 1/0175 |
| 2019/0088038 | A1* | 3/2019 | Higuchi | G07B 15/06 |
| 2019/0304297 | A1* | 10/2019 | Burley, IV | H04N 5/247 |
| 2020/0043326 | A1* | 2/2020 | Tao | G07C 5/008 |

FOREIGN PATENT DOCUMENTS

| | | | |
|---|---|---|---|
| WO | WO 2017102259 | A1 | 6/2017 |
| WO | WO 2018/098161 | A1 | 5/2018 |

OTHER PUBLICATIONS

Berthold Färber, "Communication and Communication Problems Between Autonomous Vehicles and Human Drivers," 2016, pp. 125-144, Chapter 7, M. Maurer et al. (eds.), Autonomous Driving, DOI 10.1007/978-3-662-48847-8_7, Bundeswehr Universität München, Neubiberg, Germany.

Tobias Lagström and Victor Malmsten Lundgren, "AVIP—Autonomous Vehicles' Interaction With Pedestrians, An Investigation of Pedestrian-Driver Communication and Development of a Vehicle External Interface," 2015, 84 Pages, Chalmers University of Technology, Master of Science Thesis in the Master Degree Program Industrial Design Engineering, Gothenborg, Sweden.

Samir Torki, Patrice Torguet, Cédric Sanza, Jean-Pierre Jessel, "Classifer System Based Autonomous Vehicles in HLA Distributed Driving Simulations," 2005, 11 Pages, Virtual Reality & Computer Graphics Research Group, IRIT, Université Paul Sabatier, France.

* cited by examiner

TRAFFIC MANAGEMENT SYSTEM

FIELD OF THE DISCLOSURE

This disclosure relates generally to traffic management and, more particularly, to a traffic management system that manages autonomous actors and non-autonomous actors in an environment.

BACKGROUND

Situations are becoming more common where autonomous vehicles including fully-autonomous and semi-autonomous vehicles, such as unmanned aerial vehicles (UAVs), ground vehicles (e.g., cars, trucks, buses, and motorcycles), and watercraft (e.g., boats and submersibles) are traversing an environment where non-autonomous actors including other new disruptive non-autonomous transportation besides automobiles (e.g., electric scooters, electric bikes, hoverboards, etc.) are also traversing. Additionally, actors lacking the appearance of agency (e.g., minors, pets, simple robots that have less control over their activity or less knowledge of legal requirements are often present in an environment. Detection and enforcement of law violations and community norms is increasingly a challenge in an environment with these actors.

SUMMARY

Embodiments of the present disclosure describe systems and methods that provide for a method of traffic management. During the method, first sensor data is received from a physical environment. The first sensor data is computationally processed to identify a first visual indication in the sensor data. It is determined that the first visual indication is associated with a first policy agreement. It is then determined, based on the first sensor data, that a first visual indicator system that provided the first visual indication is violating a first policy included in the first policy agreement and, in response, a policy violation notification provided indicating that the first visual indicator system is violating the first policy.

Embodiments of the present disclosure describe systems and methods that provide for a visual indicator system that includes a sensor system, a visual indicator, a processing system, and a memory system that is coupled to the processing system and that includes instructions that, when executed by the processing system, cause the processing system to provide a policy module. The policy module is configured to receive first sensor data from a physical environment. The first sensor data is computationally processed to identify a first visual indication in the sensor data. The policy module determines that the first visual indication is associated with a first policy agreement. The policy module then determines, based on the first sensor data, that a first visual indicator system that provided the first visual indication is violating a first policy included in the first policy agreement and, in response, provides a policy violation notification indicating that the first visual indicator system is violating the first policy.

Embodiments of the present disclosure describe systems and methods that provide for a tangible machine-readable storage medium including machine readable instructions which, when executed, cause one or more processors of a device to perform operations that include receiving first sensor data from a physical environment; computationally processing the first sensor data to identify a first visual indication in the sensor data; determining the first visual indication is associated with a first policy agreement; and determining, based on the first sensor data, that a first visual indicator system that provided the first visual indication is violating a first policy included in the first policy agreement and, in response, providing a policy violation notification that the first visual indicator system is violating the first policy.

Figure 1:
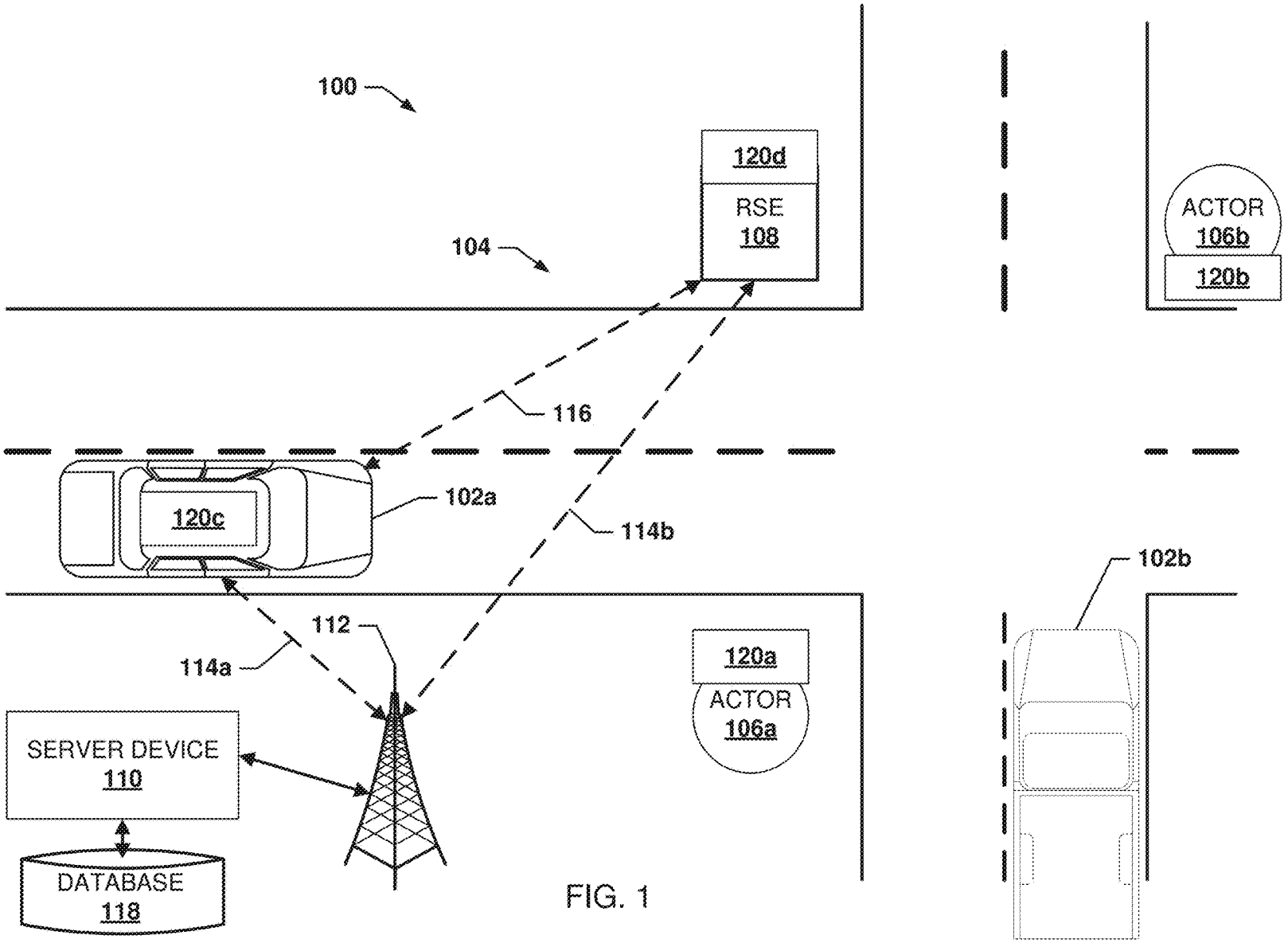
FIG. 1 is a schematic view illustrating an embodiment of a traffic management system.

Embodiments of the present disclosure and their advantages are best understood by referring to the detailed description that follows. It should be appreciated that like reference numerals are used to identify like elements illustrated in one or more of the figures, where showings therein are for purposes of illustrating embodiments of the present disclosure and not for purposes of limiting the same.

DETAILED DESCRIPTION

The systems and methods of the present disclosure provide for traffic management system. As discussed above, detection and enforcement of law violations and community norms is increasingly a challenge in an environment with various types of actors (e.g., autonomous vehicles, drones, non-autonomous vehicles, personal transportation devices, actors that lack agency, and the like). Systems and methods of the present disclosure provide for traffic management. In various embodiments, a visual indicator system that includes a wearable device, a non-autonomous vehicle, an autonomous vehicle, or a roadside equipment unit maybe accessed and associated with an operator. The operator may agree to a policy agreement that includes one or more policies such as traffic regulation, community norms, and/or other operating policies that a manufacturer and/or a service provider of the visual indicator system or traffic management system desires operators to follow. The policy agreement may be encoded along with a policy identifier that identifies the policy agreement between the operator and the traffic management system in visual indication provided by a visual indicator (e.g., a light signaling device) included in the visual indicator system. The policy agreement and associated policy identifier may be stored in a policy ledger that is centralized or distributed to the actors within the physical environment.

Subsequently, the operator may begin operating the vehicle included in the visual indicator system. The visual indicator system may provide the policy identifier to the physical environment by generating a visual indication that includes the policy identifier as a light signal. Other visual indicator systems or monitoring devices within the physical environment may detect the visual indication, computationally process the visual indication to identify the policy identifier and determine whether a policy agreement is located in the policy ledger. If a policy agreement exists in the policy ledger for the policy identifier, the visual indicator systems or monitoring devices may monitor that visual indicator system that provided the visual indication to determine whether the policies within the policy agreement are being followed. If a policy is violated, the monitoring devices may report the policy violation to a policy violation ledger. In other examples, the monitoring devices may provide a policy violation notification to an enforcement actor to enforce the policy or penalize the operator and/or visual indicator system for violating the policy. In other examples, the monitoring devices may provide a policy violation notification to the visual indicator system that is violating the policy. The policy violation notification may include instructions to put the violating visual indicator system in compliance with the violated policy or cause the violating visual indicator system to provide a notification to the operator. Monitoring devices such as other visual indicator systems may be rewarded for reporting the violation while the violating visual indicator system may be penalized.

Referring now to FIG. 1, an embodiment of a traffic management system 100 is illustrated. In the illustrated embodiment, the traffic management system 100 includes an autonomous vehicle 102*a* (e.g., a self-driving vehicle) and a non-autonomous vehicle 102*b* provided in a physical environment 104. The physical environment 104 may be any indoor and/or outdoor space that may be contiguous or non-contiguous. For example, the physical environment 104 may include a roadway, a tunnel, a bridge, a waterway, a railway, and/or any other transportation infrastructure that would be apparent to one of skill in the art. In other examples, the physical environment 104 may include a yard, a home, a business, a park, a stadium, a museum, an amusement park, an access space, an underground shaft, an airspace, a body of water, and/or other spaces. The physical environment 104 may be defined by geofencing techniques that may include specific geographic coordinates such as latitude, longitude, and/or altitude, and/or operate within a range defined by a wireless communication signal. The physical environment 104 may include a plurality of actors such as an actor 106*a* and an actor 106*b* such as, for example, pedestrians, pets, children, cyclists, users of scooters, operators of other personal transportation devices, an operator of the autonomous vehicle 102*a*, an operator of the non-autonomous vehicle 102*b*, and/or any other actor that is capable of being in motion that would be apparent to one of skill in the art in possession of the present disclosure.

In various embodiments, the autonomous vehicle 102*a* may be implemented as an autonomous unmanned aerial vehicle (UAV), an autonomous car, an autonomous truck, an autonomous bus, an autonomous train, an autonomous submersible, an autonomous boat, any autonomous robot, an autonomous unicycle, an autonomous snowmobile, autonomous construction equipment, autonomous farming vehicles, and/or any unmanned or manned vehicular device that would be apparent to one of skill in the art in possession of the present disclosure. In various embodiments, vehicles described as autonomous may include fully-autonomous vehicles and/or semi-autonomous vehicles. In the illustrated examples of the present disclosure, the autonomous vehicle 102*a* is depicted as an autonomous automobile. As such, the autonomous vehicle 102*a* may each include an autonomous vehicle controller for making and executing decisions for the autonomous vehicles 102*a*. In various embodiments, the non-autonomous vehicle 102*b* may be implemented as a UAV, a car, a truck, a bus, a train, a motorcycle, a submersible, a boat, a snowmobile, a unicycle, construction equipment, farming equipment, and/or any unmanned or manned vehicular device that is controlled by a human user (e.g., non-autonomous).

In various embodiments, the traffic management system 100 may include a roadside equipment (RSE) unit 108. The RSE unit 108 may be provided in the physical environment 104 to direct, inform, control, and/or warn traffic (e.g., the autonomous vehicle 102*a*, the non-autonomous vehicle 102*b*, and the actors 106*a* and/or 106*b*) within the physical environment 104. For example, the RSE unit 108 may be a railroad crossing gate, a tollbooth, a parking lot gate, signage, traffic lights, a camera, or other RSE units that would be apparent to one of skill in the art in possession of the present disclosure. Of course, in various embodiments, some or all of the components of the RSE unit 108 could be physically located other than "roadside", such as in a cabinet, a signal head, a buoy, a balloon in the atmosphere, a camera attached to a building or post or otherwise. Thus, while the present disclosure discusses an RSE unit when referring to autonomous automobiles, the RSE unit 108 may be generally referred to as a traffic control unit and may be provided in a physical environment (e.g., bodies of water, in the atmosphere, in a field) where other types of autonomous vehicles other than autonomous automobiles are present. The RSE unit 108 may be used to control many different types of traffic equipment and/or can be used to collect and send data about the physical environment 104 to a central monitoring station for further analysis or action and/or the autonomous vehicle 102*a*, using common networking and communication techniques, commonly specified 5G or subsequently developed adaptive multi-bandwidth approaches. As such, the RSE unit 108 may be simply an information gathering unit that gathers information about the physical environment 104 and the equipment and actors within the physical environment 104. In various embodiments, the autonomous vehicle 102*a* and the RSE unit 108 may include communication units having one or more transceivers to enable the autonomous vehicle 102*a* and the RSE unit 108 to communicate with each other and/or a server device 110. Accordingly and as discussed in further detail below, the autonomous vehicle 102*a* may be in communication with the RSE unit 108 directly or indirectly. As used herein, the phrase "in communication," including variances thereof, encompasses direct communication and/or indirect communication through one or more intermediary components and does not require direct physical (e.g., wired and/or wireless) communication and/or constant communication, but rather additionally includes selective communication at periodic or aperiodic intervals, as well as one-time events.

For example, the autonomous vehicle 102*a* and/or the RSE unit 108 in the traffic management system 100 of FIG. 1 may include first (e.g., long-range) transceiver(s) to permit the autonomous vehicle 102*a*, and/or the RSE unit 108 to communicate with a network 112 via a communication channel 114*a* and a communication channel 114*b*. The network 112 may be implemented by an example mobile cellular network, such as a long-term evolution (LTE) network or other third generation (3G), fourth generation (4G) wireless network, or fifth-generation (5G) wireless network. However, in some examples, the network 112 may be additionally or alternatively be implemented by one or more other communication networks, such as, but not limited to, a satellite communication network, a microwave radio network, and/or other communication networks.

The autonomous vehicle 102*a*, and/or the RSE unit 108 additionally may include second (e.g., short-range) transceiver(s) to permit the autonomous vehicle 102*a* and/or the RSE unit 108 to communicate with each other via communication channel 116. The second transceiver may be used for vehicle-to-vehicle communications between the autonomous vehicle 102*a* and other autonomous vehicles. In the illustrated example of FIG. 1, such second transceivers are implemented by a type of transceiver supporting short-range (e.g., operate at distances that are shorter than the long-range transceivers) wireless networking. For example, such second transceivers may be implemented by a Wi-Fi transceiver (e.g., via a Wi-Fi Direct protocol), a Bluetooth® transceiver, an infrared (IR) transceiver, a Zigbee transceiver, and/or other transceivers that are configured to allow the autonomous vehicle 102*a* and/or the RSE unit 108 to intercommunicate via an ad-hoc or other wireless network.

The actor 106*a*, the actor 106*b* may operate equipment (e.g., a wearable device, a personal transportation device, and/or other equipment) that includes a visual indicator system 120*a* and 120*b*, respectively. Similarly, the autonomous vehicle 102*a* and/or the RSE unit 108 may include a visual indicator system 120*c*, and 120*d*, respectively. While the visual indicator systems 120*a*-120*d* may be separate systems than the actor operated equipment, the RSE unit 108, the non-autonomous vehicle 102*b* and the autonomous vehicle 102*a*, for ease of discussion herein, the visual indicator system 120*a* may include the equipment operated by the actor 106*a*, the visual indicator system 120*b* may include equipment operated by the actor 106*b*, the visual indicator system 120*c* may include the autonomous vehicle 102*a*, and the visual indicator system 120*d* may include the RSE unit 108. The visual indicator systems 120*a*-120*d* may provide visual indications (e.g., light signals from the visual spectrum of the electromagnetic spectrum that is visible to the human eye (e.g., wavelengths of 380-740 nm)) based on information received from the physical environment 104, the respective actor information, autonomous vehicle information, and/or RSE unit information for machine-to-human communication. However, in some embodiments the visual indicator systems 120*a*-120*d* may provide other visual indications that have wavelengths that are in the ultraviolet or infrared spectrums for machine-to-machine communication. Each visual indicator system 120*a*-120*d* may also be configured to detect the visual indications provided by other visual indicator systems within the physical environment 104. In various embodiments, the non-autonomous vehicle 102*b* may include a visual indicator system.

While, the examples discussed below are described as being provided by a visual indicator system, one of skill in the art will recognize that other machine-to-human communication systems that may be also used as machine-to-machine communication systems may be used in conjunction with or alternatively to the visual indicator system. For example, in other embodiments, the visual indicator systems 120*a*-120*d* may be accompanied by audio indicator systems using audible 20-20 kHz or non-audible frequency ranges. These audio frequency ranges can be used opportunistically to repeat a visual indicator (e.g. poor visibility due to fog allows for better low-frequency audio propagation) or complement a visual indicator (e.g. visual indicators convey one part of an information and audio indicators another). Additionally, unlike visual indicators, audio indicators could be sent as a non-directed broadcast (e.g. sound sent in every direction) or a tightly beam-formed signal (e.g. audio sent within a narrow angle from the indicator to another actor).

The traffic management system 100 also includes or may be in communication with a server device 110. For example, the server device 110 may include one or more server devices, storage systems, cloud computing systems, and/or other computing devices (e.g., desktop computing device(s), laptop/notebook computing device(s), tablet computing device(s), mobile phone(s), etc.). As discussed below, the server device 110 may be coupled to a traffic management database 118 that is configured to provide repositories such as an autonomous vehicle signaling repository of autonomous vehicle visual indication and instructions for those visual indications for autonomous vehicles within the physical environment 104. The repositories may also include a policy ledger and a policy violation ledger that may be discussed in further detail below. Also, the server device 110 may be configured to provide an autonomous vehicle controller that computationally processes sensor data (e.g., sensor data that includes environmental information, vehicle information, visual indicator information, and/or other information) received from the visual indicator systems 120*a*-120*d*, the RSE unit 108 and/or the autonomous vehicle 102*a* and render instructions to the autonomous vehicle 102*a* and/or RSE unit 108 as well as notifications based on the policies provided in the policy repository and that may be provided to one or more of the actors within the physical environment 104 or other users that are not provided in the physical environment 104.

In various embodiments, the physical environment 104 may include other devices such as smart phones, standalone cameras and sensors that that do include a visual indicator system but may be configured to detect visual indications within the physical environment 104 and report those visual indications to the server device 110 or other visual indicator systems 120*a*-120*d*. In another embodiment, some or all of the traffic provided by the autonomous vehicle 102*a*, the non-autonomous vehicle 102*b* and/or the actors 106*a*-106*b* may exclusively communicate via the visual indicator systems 120*a*-120*d* and forego non-visual communication channels 114*a*, 114*b*, 116. In this embodiment, visuals, policies, and other information (including location, time, etc) may be stored until an alternate communication channel is available. For example, the RSE 108 could communicate with the autonomous car 102*a* to establish and policy in a disconnected state (e.g., no communication channel server device 110). In this same disconnected state, other actors 106*b*, 106*a* could capture identification of the autonomous vehicle 102*a* from visual indicator system 120*c* and optionally the RSE policy from visual indicator system 120*d* to upload as visual evidence for future analysis by the server device 110 in the management system 100. While a specific traffic management system 100 has been illustrated and described, one of skill in the art in possession of the present disclosure will recognize that the teachings of the present disclosure will be beneficial for a variety of traffic management systems that would be apparent to one of skill in the art in possession of the present disclosure and, as such, a wide variety of modifications to the number, types, and orientation of devices in the traffic management system 100 will fall within the scope of the present disclosure as well.

Figure 2:
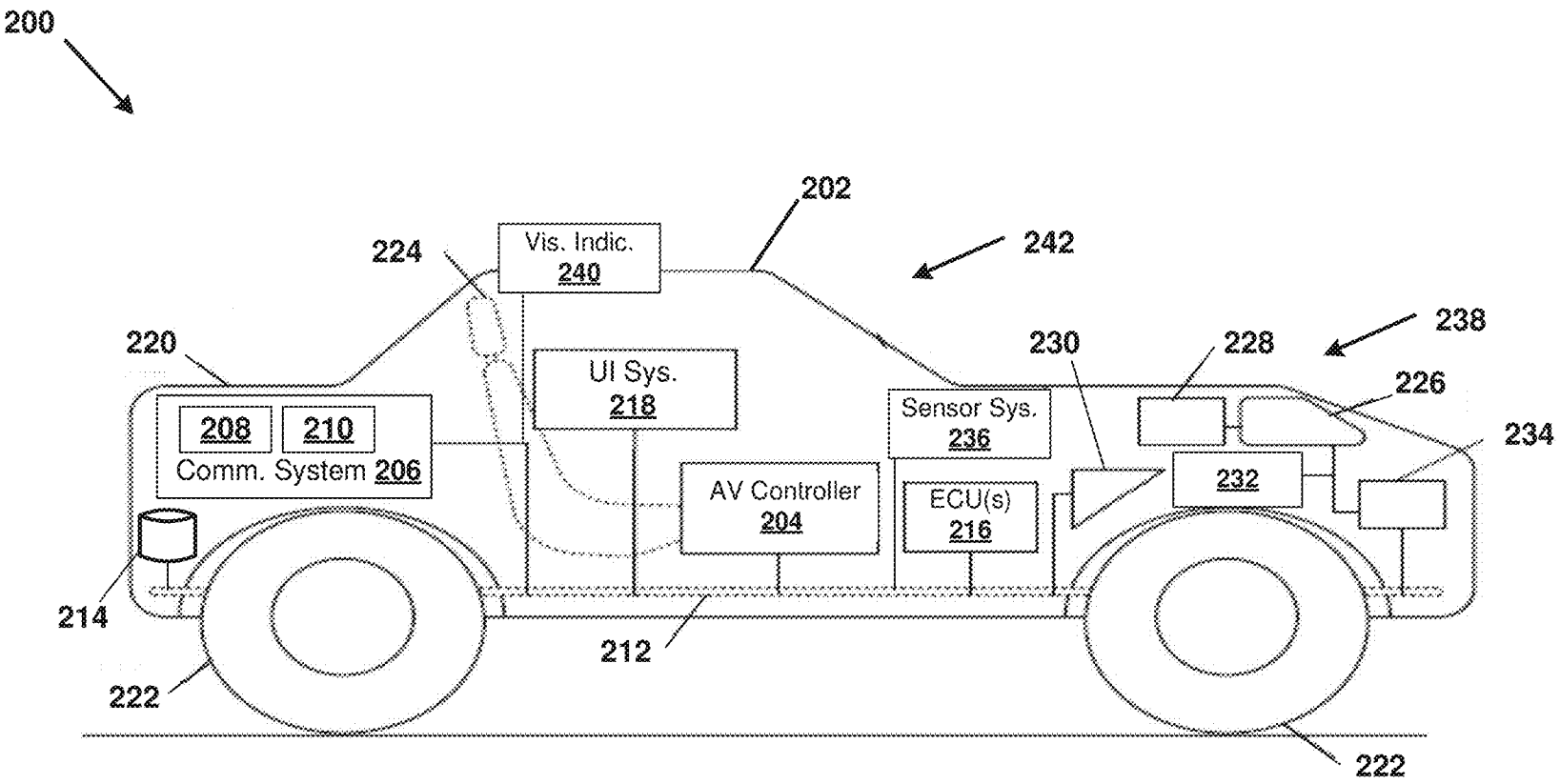
FIG. 2 is a schematic view illustrating an embodiment of an autonomous vehicle used in the traffic management system of FIG. 1.

Referring now to FIG. 2, an embodiment of an autonomous vehicle 200 is illustrated that may be the autonomous vehicles 102*a* discussed above with reference to FIG. 1. While the autonomous vehicle 200 is illustrated as an autonomous car, one of skill in the art in possession of the present disclosure may recognize that the autonomous vehicle 200 may be provided by a UAV, a robot, an unmanned vehicular device (e.g., land or water), and/or other vehicular device described above or that would be apparent to one of skill in the art in possession of the present disclosure. In the illustrated embodiment, the autonomous vehicle 200 includes a chassis 202 that houses the components of the autonomous vehicle 200. Several of these components are illustrated in FIG. 2. For example, the chassis 202 may house a processing system (not illustrated) and a non-transitory memory system (not illustrated) that includes instructions that, when executed by the processing system, cause the processing system to provide an autonomous vehicle controller 204 that is configured to perform the functions of the autonomous vehicle controllers and/or the autonomous vehicles discussed below.

The chassis 202 may further house a communication system 206 that is coupled to the autonomous vehicle controller 204 (e.g., via a coupling (e.g., a bus 212) between the communication system 206 and the processing system). The communication system 206 may include software or instructions that are stored on a computer-readable medium and that allow the autonomous vehicle 200 to send and receive information through the communication networks discussed above. For example, the communication system 206 may include a first communication interface 208 to provide for communications through the communication network 112 as detailed above (e.g., first (e.g., long-range) transceiver(s)). In an embodiment, the first communication interface 208 may be a wireless antenna that is configured to provide communications with IEEE 802.11 protocols (Wi-Fi), cellular communications, satellite communications, other microwave radio communications and/or communications. The communication system 206 may also include a second communication interface 210 that is configured to provide direct communication with other autonomous vehicles, the RSE unit 108, and/or other devices within the physical environment 104 discussed above with respect to FIG. 1 (e.g., second (e.g., short-range) transceiver(s)). For example, the second communication interface 210 may be configured to operate according to wireless protocols such as Bluetooth®, Bluetooth® Low Energy (BLE), near field communication (NFC), infrared data association (IrDA), ANT®, Zigbee®, Z-Wave® IEEE 802.11 protocols (Wi-Fi), and other wireless communication protocols that allow for direct communication between devices.

The communication system 206 of the illustrated example manages communications between the autonomous vehicle 200 and network entities (e.g., a car manufacturer, a telecommunication service provider, an internet service provider, a media provider, a certificate authority, etc.) via a wired and/or wireless connection (e.g., an IEEE 802.11 wireless connection, a Bluetooth connection, a cable/DSL/satellite modem, a cell tower, etc.). The communication system 206 of the illustrated example maintains network information (e.g., a network address, network settings, etc.) required to send and/or receive data over the various communication platforms. The communication system 206 manages the connections between the vehicle and outside entities (e.g., a Bluetooth connection between a mobile device and the example autonomous vehicle controller 204). In some examples, the communication system 206 may establish communicative connections with service providers that may provide the server device 110 and/or different network entities (e.g., a car manufacturer, a telecommunication service provider, an internet service provider, a media provider, a certificate authority, etc.) to send data from the autonomous vehicle 200 to the network entities and/or receive data from the network entities for delivery to the vehicle (e.g., driving profiles). In addition, the communication system 206 may communicate with a computing device, such as a personal electronic device (e.g., a smartphone, a tablet, a smart watch, etc.), a personal computer (e.g., a desktop, a laptop, etc.), a diagnostic computer (e.g., at a dealership, etc.), etc. In some examples, one or more computing devices connected to the autonomous vehicle 200 via the communication system 206 may transmit and receive information, such as vehicle diagnostic data, media files (e.g., movies, music, television programs, etc.) uploaded to a memory of the autonomous vehicle 200, firmware and/or software updates, driving profiles, environmental information about the physical environment 104, authentication identifiers (e.g., cryptographic keys), visual indicator information, and/or other autonomous vehicle information that would be apparent to one of skill in the art in possession of the present disclosure.

The chassis 202 may also house an autonomous vehicle storage system 214 that is coupled to the autonomous vehicle controller 204 through the processing system (e.g., via the bus 212). The autonomous vehicle storage system 214 may store sensor data, autonomous vehicle instructions and rules, visual indicator profiles that include visual indications and associated rules and instructions, user profiles, policy agreements (e.g., a service level agreement "SLA"), a policy ledger, a policy violation ledger, and/or any other information or instructions that would be apparent to one of skill in the art in possession of the present disclosure.

The chassis 202 may also house a plurality of ECUs 216 that are coupled (e.g., via the bus 212) to the autonomous vehicle controller 204 through the processing system. The example ECUs 216 of FIG. 2 may be discrete computing devices. The example ECUs 216 may include a processor (e.g., a microcontroller) to process data and execute programmable instructions (e.g., assembly level instructions, functional sequential instructions, and/or object-oriented instructions). The example ECUs 216 also are provided with on-board memory (e.g., Static Random-Access Memory (SRAM), Electrically Erasable Programmable Read Only Memory (EEPROM), and/or Flash memory) to store data received and/or generated by the ECU 216. The example ECUs 216 are further provided with Input and/or Output (I/O) ports such as supply voltage inputs, digital and/or analog inputs, relay drivers, H-bridge drivers, injector drivers, and/or logic outputs. These I/O ports are used by the ECU 216 to receive data from sensors and transmit signals to mechanical components (e.g., actuators) to affect the mechanical components operations based on the operating parameters of the autonomous vehicle 200. The received data and/or the transmitted signals are communicated from the ECU 216 via the data bus 212 or through a directly wired connection between the ECU 216 and the mechanical component.

The example ECUs 216 of FIG. 2 control low level systems (e.g., door controls, headlight controls, engine controls, transmission controls, climate controls, seat controls, mirror controls, etc.) and/or high-level systems (e.g., radio systems, voice controls, entertainment systems, a telematic control unit managing a GPS/Navigation system, etc.) connected to the data bus 212. Each ECU 216 monitors its corresponding system by reading sensor signals. These sensors are placed on the mechanical components of the system and report factors such as position, temperature, speed, etc. These factors contribute to if, when, and/or how the ECU 216 generates output signals to execute control over the corresponding system.

For example, the ECU 216 responsible for door control has sensors monitoring door lock buttons, position of doors (e.g., open or closed), door locks (e.g., engaged or disengaged), and/or child lock switches (e.g., engaged or disengaged). Based on the readings of these sensors, the door control ECU 216 may, for example, decide on whether to generate a lock engaging signal to the doors of the vehicle.

Each of the ECUs 216 may be of different size and/or complexity according to the system the individual ECU 216 is controlling. In the illustrated example, the ECUs 216 are in communication with other units of the vehicle via the data bus 212. In some examples, the ECUs 216 may send information (e.g., the status of the systems or components of the vehicle, diagnostic information, telemetry data, environmental information, visual indicator information, etc.) to a remote device (e.g., a mobile device such as a smartphone, tablet, smartwatch, etc.) via the communication system 206 and/or may receive information (e.g., commands, driving profiles, operating parameters, firmware/software updates, media files, environmental information, signaling system standards etc.) from the remote device via the communication system 206. For example, such information may be communicated between the ECUs 216 and the remote device using a Bluetooth, Wi-Fi, or near field communication (NFC) connection generated and/or managed by the communication system 206.

The ECUs 216 may be deployed in a one-to-one fashion. That is, each ECU 216 is provided with processing power and system memory ample enough to control a corresponding single system of the vehicle. Each ECU 216 may vary in size according to the complexity of the corresponding system. In some examples, however, the ECUs 216 in the example autonomous vehicle 200 may be more robust and capable of controlling multiple systems (e.g., an ECM of the ECUs 216 may control the engine and the transmission system). For example, a robust ECU may be provided with amounts of processing power greater than a ECU processor for controlling a single system (e.g., more cores, faster clocking speeds, larger processing cache, etc.) and higher amounts of random access memory (RAM) may control more than one system as is typical of the average ECU.

The chassis 202 of the autonomous vehicle 200 may also house a user interface (UI) system 218 coupled to the autonomous vehicle controller 204 through the processing system. The user interface system 218 may include components such as a dashboard display, a media center, a center console display, user accessible buttons (e.g., climate controls, door lock controls), etc. The user interface system 218 may also include a data store to store media (e.g., movies, music, television programs, podcasts, etc.), system firmware, navigation data, diagnostic information, data collected by data collection systems (e.g., cameras mounted externally on the autonomous vehicle, weather data collection, etc.), driving profiles, etc. The example user interface system 218 also functions as a human-to-machine interface that provides options to the user/actor of the autonomous vehicle 200 and communicates the user's selected options to the corresponding ECU 216 and/or the autonomous vehicle controller 204.

In the illustrated example of FIG. 2, the chassis 202 of the autonomous vehicle 200 may include a body 220, a wheel 222 (in examples where the autonomous vehicle is an autonomous automobile), a seat 224, a motor 226, a cooling system 228, a transmission 230, a braking system 232, a battery 234 (e.g., an electrical system), and/or a visual indicator 240. In the illustrated example, the body 220 covers the exterior of the autonomous vehicle 200 to protect and/or contain the other parts of the autonomous vehicle 200. In various embodiments of the autonomous vehicle of FIG. 2, the ECUs 216, via commands from the autonomous vehicle controller 204, may control the braking system 232, the cooling system 228, the transmission 230, the motor 226 and/or any other autonomous vehicle systems that are apparent to one of skill in the art in possession of the present disclosure. In various embodiments, components that enable the autonomous vehicle 200 to steer, accelerate, decelerate, and/or perform any other mechanical functions may be referred to a drive system 238. As such, the drive system 238 may also include a wheel 222, the motor 226, the cooling system 228, the transmission 230 and/or any other system used to navigate the autonomous vehicle 200 in the physical environment 104.

In the illustrated example, the motor 226 may be implemented by a combustion engine, a DC electric motor, and/or an AC electric motor. The motor 226 may be communicatively coupled to the ECUs 216 and the transmission 230. The example ECU 216 may receive operating power from batteries 234 to control components of the motor 226 (e.g., throttle valve, sparkplugs, pistons, fuel injectors, etc.). The ECU 216 for the motor 226 receives signals from a user (e.g., via sensors in a pedal, etc.) and/or the autonomous vehicle controller 204 to determine corresponding control signals to communicate to the example motor 226 (e.g., manipulating throttle valve, firing spark plugs, altering fuel injection quantities, etc.). In the illustrated example, the motor 226 supplies torque to the transmission 230 to drive one or more wheels 222.

In various embodiments, the autonomous vehicle 200 may include a sensor system 236 that may be housed in the chassis 202 and/or provided on the chassis 202. The sensor system 236 may be coupled (e.g., coupled via the bus 212) to the autonomous vehicle controller 204 via the processing system. The sensor system 236 may include one or more sensors that gather sensor data about the autonomous vehicle 200 and/or physical environment 104 that may be provided to the autonomous vehicle controller 204 via the bus 212. The sensor data (e.g., environmental data) may be used by the autonomous vehicle controller 204 to make decisions regarding control signals to provide to ECUs 216 of the autonomous vehicle 200 to control the various systems when the autonomous vehicle 200 is in use and navigating the physical environment 104.

In various embodiments, the autonomous vehicle 200 may include a visual indicator system 242 that may be housed in the chassis 202 and/or provided on the chassis 202 and that may be the visual indicator system 120*c* of FIG. 1. The visual indicator system 242 may include the visual indicator 240 that may include a headlight, a turn signal, brake light and/or any additional lighting apparatus mounted to the chassis 202. The visual indicator 240 may be configured to generate 100-1,000,000 lumens of light, such as full spectrum of visible light, a partial spectrum of visible light, and/or is adjustable based on the amount of sunlight illuminating the physical environment 104 such that the light generated by the visual indicator 240 may be distinguishable from the illumination of the physical environment 104 by the sun (e.g., partial or full sun) and/or some artificial lighting in cases where the physical environment 104 is indoors. However, one of skilled in the art in possession of the present disclosures will recognize that other quantities of light and/or spectrums of light may be contemplated and fall within the scope of the present disclosure. For example, infrared (IR) and ultraviolet (UV) light sources at various power levels can also be utilized for machine-to-machine communication. For example, UV sources can be used for fully passive observance of behavior with non-autonomous actors utilizing unique properties of reflection and refraction versus other light spectra. Additionally, point-to-point UV communications systems have been recently demonstrated to achieve very high transmission rates (up to 71 Mbit at incident angles up to 12 degrees).

Furthermore, as discussed above, the visual indicator system 242 may be accompanied by an audio indicator system using audible 20-20 kHz or non-audible frequency ranges. These audio frequency ranges can be used opportunistically to repeat a visual indicator (e.g. poor visibility due to fog allows for better low-frequency audio propagation) or complement a visual indicator (e.g. visual indicators convey one part of an information and audio indicators another). However, in other embodiments, the audio indicator system may replace the visual indicator system.

In an embodiment, if the visual indicator 240 includes a plurality of lights, the lights may be provided in different arrangements (e.g., a circular arrangement, a linear arrangement, an oval arrangement, a quadrilateral arrangement, and/or any other shaped arrangement that would be apparent to one of skill in the art in possession of the present disclosure. Each of the plurality of lights may be configured to independently activate and/or deactivate such that various visual indications (e.g., light patterns) may be provided by the visual indicator 240 by activating and deactivating particular lights. If the visual indicator 240 is replaced by an audio indicator or provided in addition to the visual indicator 240, audio indications could be sent as a non-directed broadcast (e.g. sound sent in every direction) or a tightly beam-formed signal (e.g. audio sent within a narrow angle from the audio indicator to another actor).

The visual indicator system 242 may also include the sensor system 236 or a portion of the sensor system 236 that includes an imaging sensor system and/or a light detector for detecting light from visual indicators and decode a quick response code of visual indicators generated by other visual indicator systems within the physical environment 104, as discussed in more detail below. The visual indicator system 242 may also include the communication system 206, the autonomous vehicle storage system 214 for storing visual indicator profiles that visual indications associated with instructions, rules and/or conditions, the autonomous vehicle controller 204 for processing visual indications received and/or providing visual indications via the visual indicator 240 based decisions made by the autonomous vehicle controller, and/or various ECUs for controlling the visual indicators.

Figure 3:
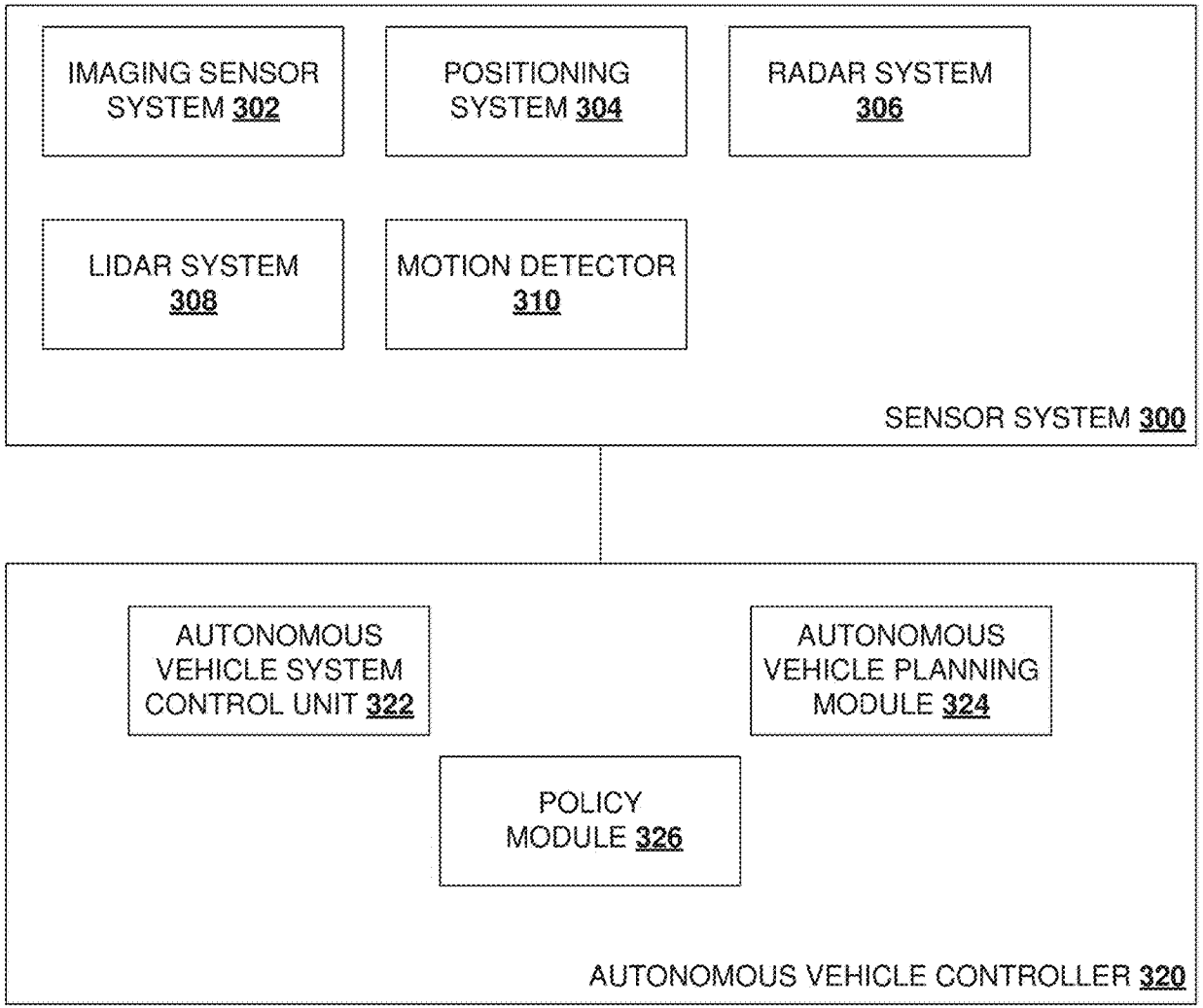
FIG. 3 is a schematic view illustrating an embodiment of a sensor system and an autonomous vehicle controller of the autonomous vehicle of FIG. 2.

Referring to FIG. 3, the sensor system 300 is illustrated that may be the sensor system 236 of FIG. 2. The sensor system 300 may include an imaging sensor system 302, a positioning system 304, a radar system 306, a lidar system 308, a motion detector 310, and/or any other sensors that would be apparent to one of skill in the art in possession of the present disclosure used for autonomously navigating the autonomous vehicle 200 through the physical environment 104 and/or operating the autonomous vehicle 200. In various embodiments, the imaging sensor system 302 may include a plurality of imaging sensors that provide on various locations of the chassis 202. For example, the imaging sensors may include, a two-dimensional image capturing camera, a three-dimensional image capturing camera, an infrared image capturing camera, a depth capturing camera, similar video recorders, and/or a variety of other image capturing devices. The imaging sensors may also include photodetectors to that may be used to gather visual indications from the physical environment 104. The imaging sensor system 302 may be used to gather visual information from the physical environment 104 surrounding the autonomous vehicle 200, for use in recognizing an actor (e.g., actor 106*a* and 106*b*, other autonomous vehicles, non-autonomous vehicles, etc.) in the physical environment 104, and other functionality with the autonomous vehicle 200. In various examples, the imaging sensor may be mechanically movable, for example, by mounting the camera on a rotating and/or tilting a platform. In addition to or in place of the imaging sensor, an audio sensor (e.g., a microphone) may be included in the sensor system 300 and may be configured to capture audio indications in the physical environment 104.

The sensor system 300 may also include the positioning system 304 that is coupled to the autonomous vehicle controller 204. The positioning system 304 may include sensors for determining the location and position of the autonomous vehicle 200 in the physical environment 104. For example, the positioning system 304 may include a global positioning system (GPS) receiver, a real-time kinematic (RTK) GPS receiver, a differential GPS receiver, a Wi-Fi based positioning system (WPS) receiver, an accelerometer, and/or other positioning systems and components.

The sensor system 300 may include a radar system 306 which may represent a system that utilizes radio signals to sense objects within the physical environment 104 of the autonomous vehicle 200. In some embodiments, in addition to sensing actors, the radar system 306 may additionally sense the speed and/or heading of the actors.

The sensor system 300 may include the lidar system 308, the lidar system 308 may include a light generator, for example, a laser device (e.g., a laser used in lidar (e.g., sometimes referred to as an acronym for light detection and ranging (LIDAR)), a laser scanner, a flash device (e.g., a flash LED, an electronic flash, etc.), and/or any other light generator for use in lidar and/or photogrammetry applications that would be apparent to one of skill in the art in possession of the present disclosure. The lidar system 308 may include an imaging sensor or light detector in capturing the light from the light generator that is reflected from actors (e.g., actors 106*a* and/or 106*b*) in the physical environment 104. For example, the lidar system 308 may utilize any of the imaging sensors in the imaging sensor system 302 or include its own imaging sensor (e.g., a camera).

The sensor system 300 may also include a motion detector 310. The motion detector 310 may include an accelerometer, a gyroscope, and/or any other sensor for detecting and/or calculating the orientation and/or movement of the autonomous vehicle 200.

The sensor system 300 may further include other sensors, such as, a lighting sensor (to detect and decode visual indications as described herein), a sonar sensor, an infrared sensor, an ultraviolet sensor, a steering sensor, a throttle sensor, a braking sensor, and an audio sensor (e.g., a microphone). An audio sensor may be configured to capture sound from the physical environment 104 surrounding the autonomous vehicle 200. A steering sensor may be configured to sense the steering angle of a steering wheel, the wheel(s) 222 of the autonomous vehicle 200, or a combination thereof. A throttle sensor and a braking sensor may sense the throttle position and braking position of the autonomous vehicle 200, respectively. In some situations, a throttle sensor and a braking sensor may be integrated as an integrated throttle/braking sensor.

FIG. 3 also illustrates an autonomous vehicle controller 320 coupled to the sensor system 300 and that may be the autonomous vehicle controller 204 of FIG. 2. The autonomous vehicle controller 320 may include an autonomous vehicle system control unit 322 that includes modules that control and interact with the various systems of the autonomous vehicle 200. For example, autonomous vehicle system control unit 322 may communicate via the bus 212 via the various ECUs 216. In one embodiment, the autonomous vehicle system control unit 322 includes, but is not limited to, a steering unit, a throttle unit (also referred to as an acceleration unit), a braking unit, a visual indicator module, a transmission unit, and/or any other autonomous vehicle system unit that would be apparent one of skill in the art in possession of the present disclosure. For example, the autonomous vehicle system control unit 322 may be configured to communicate with respective ECUs for the brake system, the throttle system, the steering system, the visual indicator system and/or other systems of the autonomous vehicle. For example, the steering unit may adjust the direction or heading of the autonomous vehicle 200. The throttle unit may control the speed of the motor 226 or engine that in turn control the speed and acceleration of the autonomous vehicle 200. The braking unit may control the braking system 232 to decelerate the autonomous vehicle 200 by providing friction to slow the wheel(s) 222 or tire(s) of the autonomous vehicle. The steering unit may turn the wheel(s) 222 or tire(s) of the autonomous vehicle 200. Accordingly, a driving maneuver may include any driving actions performed by the autonomous vehicle 200, for example, by using one, or a combination, of the steering unit, the throttle unit, and the braking unit. The visual indicator module may communicate driving maneuvers of the autonomous vehicle 200 to the physical environment 104 by providing visual indications through the visual indicator 240 according visual indicator profiles under a convention that should be understandable to actors 106*a* and/or 106*b*. In another embodiment, the available modes for the ECUs may be modified after receiving signals from the autonomous vehicle system control unit 322. For example, more aggressive autonomous driving, passing, and navigation modes (e.g., as "Mad Max" mode of Tesla, Inc.™ of Palo Alto, Calif.) maybe be enabled or disabled in response to a signal from the autonomous vehicle system control unit 322 when different non-autonomous or alternate autonomous vehicles are detected and communicated with through the proposed method. In another example, the enablement of these modes may be communicated with the visual indicator 240 that explicitly alerts the driver of a potential hazard.

The autonomous vehicle controller 320 may also include autonomous vehicle planning module 324. The autonomous vehicle planning module 324 may include a plurality of modules for perceiving the physical environment 104 and planning a route through the physical environment 104 according to instructions received by a user or externally provided data subsystem application. For example, the autonomous vehicle planning module 324 may manage environmental information such as localization data related to a trip or route of the user or application of the autonomous vehicle 200, such as for example a map, location information, route information, traffic information and other localization information.

Based on the sensor data provided by the sensor system 300 and the environmental information obtained by the localization module, a perception of the physical environment 104 is determined by the autonomous vehicle planning module 324. The perception information may represent what an ordinary driver would perceive surrounding a vehicle in which the driver is driving. The perception can include the lane configuration (e.g., straight or curve lanes), traffic light signals, a relative position of another vehicle, a pedestrian, a building, a crosswalk, or other traffic related signs (e.g., stop signs, yield signs), visual indications coming from visual indicator systems within the physical environment, and/or other perceptions that would be apparent to one of skill in the art in possession of the present disclosure. The autonomous vehicle planning module 324 may include a computer vision system or functionalities of a computer vision system to process and analyze images captured by one or more imaging sensors of the imaging sensor system 302 in order to identify objects, actors, and/or features in the physical environment 104 of the autonomous vehicle 200. The actors may include the actors 106*a* and/or 106*b* described above. The computer vision system may use an actor recognition algorithm, video tracking, and other computer vision techniques. In some embodiments, the computer vision system can map an environment, track actors and devices in the physical environment 104, and estimate the speed of actors and devices in the physical environment 104, etc. The autonomous vehicle planning module 324 can also detect traffic (e.g., actors and devices in the physical environment 104) based on other sensor data provided by other sensors such as the radar system 306 and/or the lidar system 308 or by the visual indicator 240 provided by a visual indicator system 242, which may provide a more instantaneous information about the traffic such as whether they are accelerating, decelerating, direction they are about to move and/or other actor intent information that would be apparent to one of skill in the art in possession of the present disclosure. The visual indications may provide more timely information to the autonomous vehicle 200 and/or may be more discernible than imaging the traffic within the physical environment 104.

For traffic, the autonomous vehicle planning module 324 decides regarding how to handle the traffic. For example, for a particular traffic unit (e.g., another vehicle in a crossing route) as well as its metadata describing the traffic (e.g., a speed, direction, turning angle), which may include translations of the visible indications received from visible indicator systems within the physical environment to metadata describing the traffic, the autonomous vehicle planning module 324 decides how to encounter the traffic (e.g., overtake, yield, stop, pass). The autonomous vehicle planning module 324 may make such decisions according to a set of rules such as traffic rules, which may be stored in the autonomous vehicle storage system 214. The set of rules may include policy rules that are based on a policy agreement (e.g., a service level agreement (SLA)) between an operator/actor of the autonomous vehicle 200, discussed in more detail below. Based on a decision for the traffic perceived, the autonomous vehicle planning module 324 plans a path or route for the autonomous vehicle 200, as well as driving parameters (e.g., distance, speed, and/or turning angle). That is, for a given traffic unit, the autonomous vehicle planning module 324 decides an action to take based on the traffic unit and how to take the action. The autonomous vehicle planning module 324 generates planning and control data including information describing how the autonomous vehicle 200 should move in a next interval. The planning and control data, is fed by the autonomous vehicle planning module 324 to the autonomous vehicle system control unit 322 that controls and drives the autonomous vehicle 200, by sending proper commands or signals to the autonomous vehicle system control unit 322, according to a route or path defined by the planning and control data. The planning and control data include sufficient information to drive the autonomous vehicle 200 from a first point to a second point of a route or path.

In various embodiments, autonomous vehicle controller 320 may also include a policy module 326. The policy module 326 may be configured to operate with the visual indicator module 408 to determine whether any visual indications received from the traffic (e.g., the non-autonomous vehicle 102*b*, the actor 106*a*, the actor 106*b*, or the RSE unit 108) in the physical environment 104 are operating according to a policy agreement, as discussed in further detail below. While a specific autonomous vehicle 200, sensor system 300, and autonomous vehicle controller 320 has been illustrated and described, one of skill in the art in possession of the present disclosure will recognize that the teachings of the present disclosure will be beneficial for a variety of autonomous vehicles, sensor systems, and autonomous vehicle controllers that would be apparent to one of skill in the art in possession of the present disclosure and, as such, a wide variety of modifications to the number, types, and orientation of devices and modules in the autonomous vehicle 200, the sensor system 300, and the autonomous vehicle controller 320 will fall within the scope of the present disclosure as well.

Figure 4:
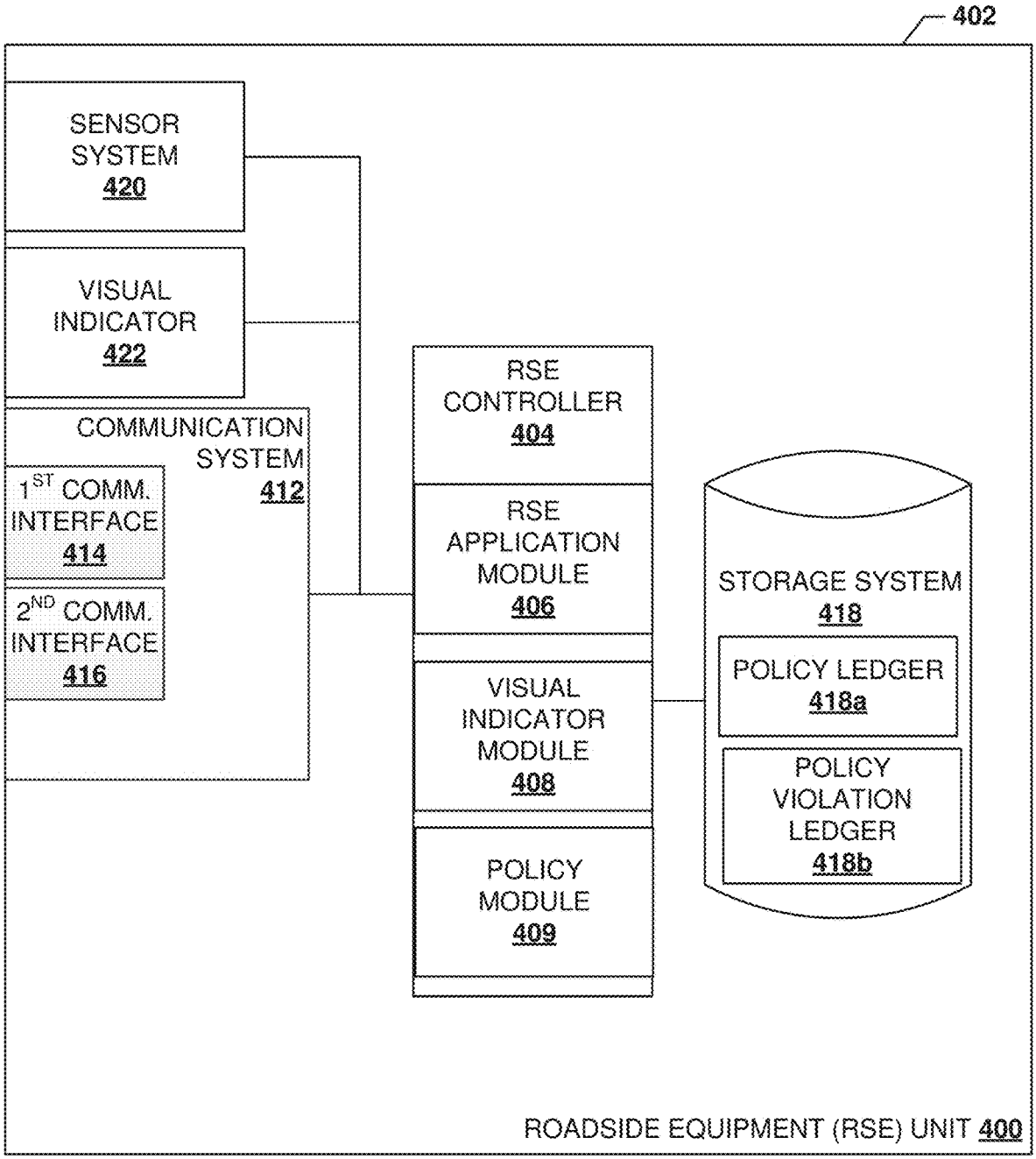
FIG. 4 is a schematic view illustrating an embodiment of a roadside equipment (RSE) unit used in the traffic management system of FIG. 1.

Referring now to FIG. 4, an embodiment of a roadside equipment (RSE) unit 400 is illustrated that may be the RSE unit 108 discussed above with reference to FIG. 1. In the illustrated embodiment, the RSE unit 400 includes a chassis 402 that houses the components of the RSE unit 400. Several of these components are illustrated in FIG. 4. For example, the chassis 402 may house a processing system (not illustrated) and a non-transitory memory system (not illustrated) that includes instructions that, when executed by the processing system, cause the processing system to provide an RSE controller 404 that is configured to perform the functions of the RSE controllers and/or the autonomous vehicles discussed below. In the specific example illustrated in FIG. 4, the RSE controller 404 is configured to provide an RSE application module 406 to perform specific functions of the RSE unit 400. For example, if the RSE unit 400 is a traffic light, the RSE application module 406 may include instructions to operate the signals of the traffic light. However, in other embodiments, the RSE unit 400 may be dedicated for facilitating autonomous vehicle traffic, as such the RSE application module 406 may be configured to generate and provide the specific autonomous vehicle instructions to the autonomous vehicles 102*a* and/or 102*b* in the physical environment 104. In other specific examples, the RSE unit 108 may be a traffic gate and the RSE application module 406 may execute instructions to operate the traffic gate (e.g., raising and lowering). The RSE controller 404 may also include a visual indicator module 408 that may operate similar to the visual indicator module of the autonomous vehicle system control unit 322 discussed above in FIG. 3. As such, the visual indicator module 408 may generate visual indications via a visual indicator 422 based on environmental information generated by a sensor system. The visual indicator module 408 may also be configured to process visual indications received from other visual indicator systems in the physical environment 104.

In various embodiments, RSE controller 404 may also include a policy module 409. The policy module 409 may be configured to operate with the visual indicator module 408 to operate with the visual indicator module 408 to determine whether any visual indications received from visual indicator systems (e.g., visual indicator systems 120*a*-120*d*) in the physical environment 104 are operating according to a policy agreement, as discussed in further detail below.

The chassis 402 may further house a communication system 412 that is coupled to the RSE controller 404 (e.g., via a coupling between the communication system 412 and the processing system). The communication system 412 may include software or instructions that are stored on a computer-readable medium and that allow the RSE unit 400 to send and receive information through the communication networks discussed above. For example, the communication system 412 may include a first communication interface 414 to provide for communications through the network 112 as detailed above (e.g., first (e.g., long-range) transceiver(s)). In an embodiment, the first communication interface 414 may be a wireless antenna that is configured to provide communications with IEEE 802.11 protocols (Wi-Fi), cellular communications, satellite communications, other microwave radio communications and/or communications. The communication system 412 may also include a second communication interface 416 that is configured to provide direct communication with the autonomous vehicle 102*a*, other RSE units, and/or other devices within the physical environment 104 discussed above with respect to FIG. 1 (e.g., second (e.g., short-range) transceiver(s)). For example, the second communication interface 416 may be configured to operate according to wireless protocols such as Bluetooth®, Bluetooth® Low Energy (BLE), near field communication (NFC), infrared data association (IrDA), ANT®, Zigbee®, Z-Wave® IEEE 802.11 protocols (Wi-Fi), and other wireless communication protocols that allow for direct communication between devices.

The chassis 402 may also house a storage system 418 that is coupled to the RSE controller 404 through the processing system. The storage system 418 may store sensor data, autonomous vehicle instructions, visual indicator profiles that include visual indications associated with instructions, conditions, and/or translations that would be apparent to one of skill in the art in possession of the present disclosure. The storage system 418 may also store a policy ledger 418*a* and/or a policy violation ledger 418*b* which may be a complete copy and/or a portion of a policy ledger and/or policy violation ledger for the traffic management system 100.

In various embodiments, the RSE unit 400 may include a sensor system 420 that may be housed in the chassis 402 and/or provided on the chassis 402. The sensor system 420 may be coupled to the RSE controller 404 via the processing system. The sensor system 420 may include one or more sensors that gather sensor data about the RSE unit 400 and/or physical environment 104 that may be provided to the RSE controller 404 and more specifically to the visual indicator module 408. The sensor data may be used by the visual indicator module 408 to generate visual indications via the visual indicator 422. In various embodiments, the sensor system 420 may include the sensor system 300 of FIG. 3.

The chassis 402 may also house the visual indicator 422 or the visual indicator 422 may be partially provided on the chassis 402 to provide a direct line-of-sight with the physical environment 104. The visual indicator 422 may include one or more lights (e.g., Light-emitting diodes (LEDs), halogen bulbs, fluorescent bulbs, incandescent bulbs, lasers, and/or other light generating devices) that are configured to generate 100-1,000,000 lumens of light, such as the full spectrum of visible light, a partial spectrum of visible light, and/or are configured to provide adjustable illumination based on the amount of sunlight illuminating the physical environment 104 such that the light generated by the visual indicator 422 may be distinguishable from the illumination of the physical environment 104 by the sun (e.g., partial or full sun) and/or some artificial lighting in cases where the physical environment 104 is indoors. In other embodiments, the visual indicator 422 may include an infrared (IR) source and/or an ultraviolet (UV) light source at various power levels that can also be utilized for machine-to-machine communication. For example, UV sources can be used for fully passive observance of behavior with non-autonomous actors utilizing unique properties of reflection and refraction versus other light spectra. Additionally, point-to-point UV communications systems have been recently demonstrated to achieve very high transmission rates (up to 71 Mbit at incident angles up to 12 degrees).

If the visual indicator 422 includes a plurality of lights, the lights may be provided in different arrangements (e.g., a circular arrangement, a linear arrangement, an oval arrangement, a quadrilateral arrangement, and/or any other shaped arrangement that would be apparent to one of skill in the art in possession of the present disclosure. The each of the plurality of lights may be configured to independently activate and/or deactivate such that various visual indications may be provided by the visual indicator 422 by activating and deactivating particular lights. While an RSE unit 400 has been illustrated and described, one of skill in the art in possession of the present disclosure will recognize that the teachings of the present disclosure will be beneficial for a variety of RSE units that would be apparent to one of skill in the art in possession of the present disclosure and, as such, a wide variety of modifications to the number, types, and orientation of devices and modules in the RSE unit 400 will fall within the scope of the present disclosure as well.

Figure 5:
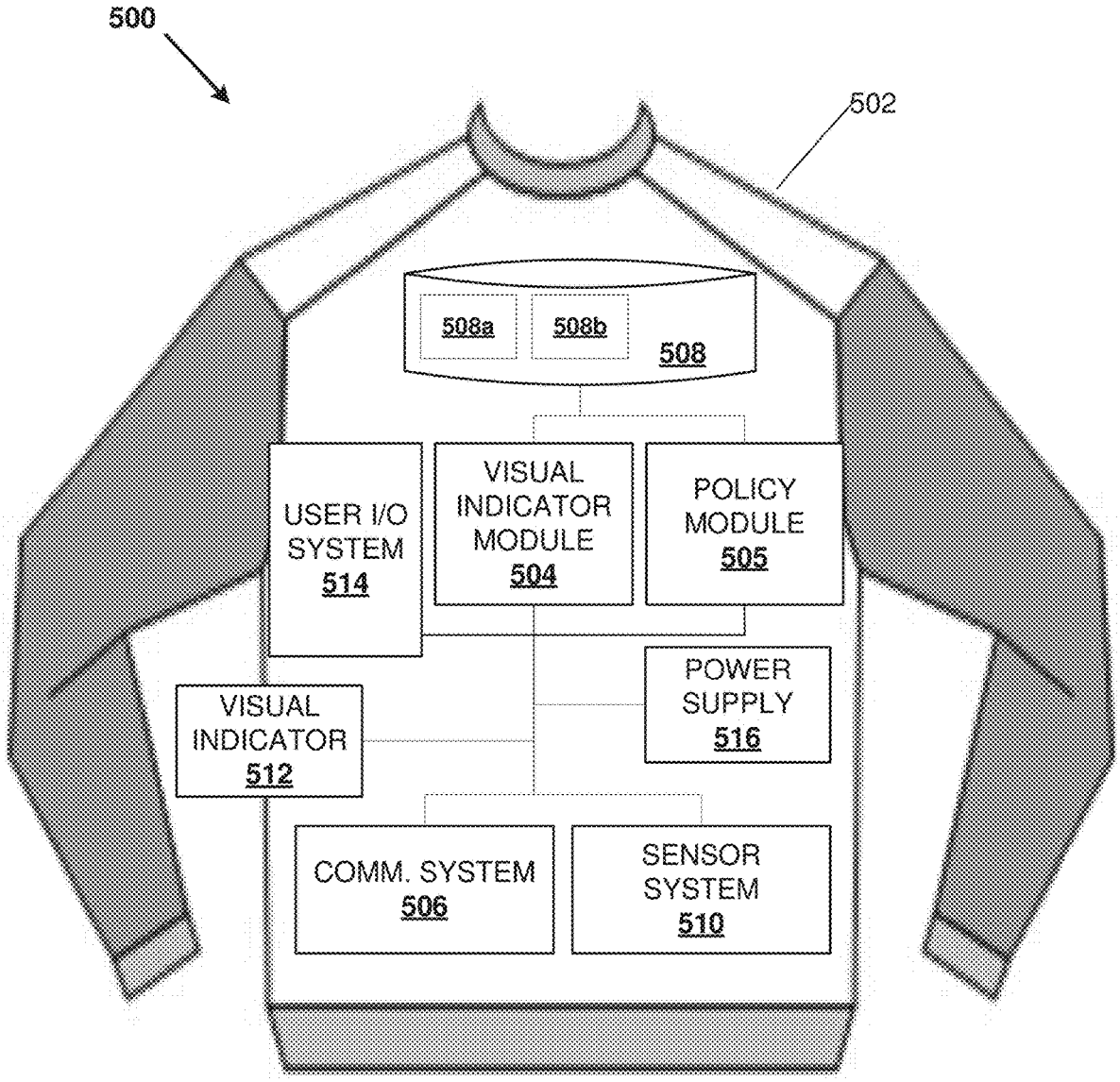
FIG. 5 is a schematic view illustrating an embodiment of a visual indicator system used in the traffic management system of FIG. 1.

Referring now to FIG. 5, an embodiment of a visual indicator system 500 is illustrated that may be visual indicator system 120*a* and/or 120*b* discussed above with reference to FIG. 1. In the illustrated embodiment, the visual indicator system 500 includes a chassis 502 that houses the components of the visual indicator system 500. The chassis 502 may include a wearable device such as, for example, a helmet, a shirt, an armband, a leg band, a vest, a shirt, a backpack, a pair of glasses, a shoe, a watch, a jacket (as illustrated as an example in FIG. 5), and/or any other wearable device that would be apparent to one of skill in the art in possession of the present disclosure. Alternative to or in addition to the wearable device, the chassis 502 may include a non-autonomous vehicle or a personal transportation vehicle (e.g., a bike, a scooter, rollerblades, a skateboard, a hoverboard, and/or any other personal transportation vehicle that would be apparent to one of skill in the art in possession of the present disclosure). In other examples, the chassis may include the autonomous vehicle 102*a* and the RSE unit 108 and as such the visual indicator systems 120*c* and 120*d* may be referred to as including the autonomous vehicle 102*a* and the RSE unit 108 herein. However, one of skilled in the art in possession of the present disclosure will recognize that the visual indicator system 500 may refer to components that attach to the chassis 502, and thus is the visual indicator system 500 may be separate from a chassis 502 that includes the wearable device, the non-autonomous vehicle, the personal transportation devices, and the like.

For various examples, the chassis 502 may house a processing system (not illustrated) and a non-transitory memory system (not illustrated) that includes instructions that, when executed by the processing system, cause the processing system to provide a visual indicator module 504 and a policy module 505 that is configured to perform the functions of the visual indicator systems, smart wear/wearable devices, non-autonomous vehicles, and/or personal transportation devices discussed below. In the specific example illustrated in FIG. 5, the visual indicator module 504 may generate visual indications to be provided on a visual indicator 512 based on environmental information and user information generated by a sensor system 510. The visual indicator module 504 may also be configured to process visual indications received from the autonomous vehicle 102*a*, the RSE unit 108 and/or other actors 106*a* and/or 106*b* in the physical environment 104. In various embodiments, the policy module 505 may be configured to operate with the visual indicator module 504 to establish policy agreements with a user/actor of the visual indicator system 500 and/or to enforce policy agreements established between the user/actor of the visual indicator system 500 and a regulatory agency and/or a service provider of the visual indicator system 500. In other embodiments the policy module 505 may be configured to enforce policy agreements of other actors within the physical environment 104 by determining whether any visual indications received from visual indicator systems (e.g., the visual indicator systems 120*a*-120*d*) in the physical environment 104 are operating according to a policy agreement, as discussed in further detail below.

The chassis 502 may further house a communication system 506 that is coupled to the visual indicator module 504 and/or the policy module 505 (e.g., via a coupling between the communication system 506 and the processing system). The communication system 506 may include software or instructions that are stored on a computer-readable medium and that allow the visual indicator system 500 to send and receive information through the communication networks discussed above. For example, the communication system 506 may include a first communication interface to provide for communications through the network 112 as detailed above (e.g., first (e.g., long-range) transceiver(s)). In an embodiment, the first communication interface may be a wireless antenna that is configured to provide communications with IEEE 802.11 protocols (Wi-Fi), cellular communications, satellite communications, other microwave radio communications and/or communications. The communication system 506 may also include a second communication interface that is configured to provide direct communication with the autonomous vehicle 102*a*, the RSE unit 108, a user device of the actor 106*a*, the visual indicator system 120*b*, and/or other devices within the physical environment 104 discussed above with respect to FIG. 1 (e.g., second (e.g., short-range) transceiver(s)). For example, the second communication interface may be configured to operate according to wireless protocols such as Bluetooth®, Bluetooth® Low Energy (BLE), near field communication (NFC), infrared data association (IrDA), ANT®, Zigbee®, Z-Wave® IEEE 802.11 protocols (Wi-Fi), and other wireless communication protocols that allow for direct communication between devices.

The chassis 502 may also house a storage system 508 that is coupled to the visual indicator module 504 through the processing system. The storage system 508 may store sensor data, visual indicator profiles that include visual indications associated with instructions, conditions, and/or translations that would be apparent to one of skill in the art in possession of the present disclosure. The storage system 508 may also store a policy ledger 508*a* and/or a policy violation ledger 508*b* which may be a complete copy and/or a portion of a policy ledger and/or policy violation ledger for the traffic management system 100.

In various embodiments, the visual indicator system 500 may include a sensor system 510 that may be housed in the chassis 502 and/or provided on the chassis 502. The sensor system 510 may be coupled to the visual indicator module 504 via the processing system. The sensor system 510 may include one or more sensors that gather sensor data about the visual indicator system 500, a user of the visual indicator system 500, the physical environment 104 and/or a personal transportation device or non-autonomous vehicle that may be provided to the visual indicator module 504. The sensor data may be used by the visual indicator module 504 to generate visual indications via the visual indicator 512. In various embodiments, the sensor system 510 may include an accelerometer, a gyroscope, a positioning system (e.g., GPS), a heart rate monitor, other biometric sensors, an actuator, a pressure sensor, and/or any other sensor that would be apparent to one of skill in the art in possession of the present disclosure that may generate data that may provide insight into a direction, speed, position, and/or intent of the visual indicator system 500 and/or the user of the visual indicator system 500.

The chassis 502 may also house the visual indicator 512 or the visual indicator 512 may be partially provided on the chassis 502 to provide a direct line-of-sight with the physical environment 104. The visual indicator 512 may include one or more lights (e.g., Light-Emitting Diodes (LEDs), halogen bulbs, fluorescent bulbs, incandescent bulbs, lasers, and/or other light generating devices) that are configured to generate 100-1,000,000 lumens of light, such as the full spectrum of visible light, a partial spectrum of visible light, and/or are configured to provide adjustable illumination based on the amount of sunlight illuminating the physical environment 104 such that the light generated by the visual indicator 512 may be distinguishable from the illumination of the physical environment 104 by the sun (e.g., partial or full sun) and/or some artificial lighting in cases where the physical environment 104 is indoors. If the visual indicator 512 includes a plurality of lights, the lights may be provided in different arrangements (e.g., a circular arrangement, a linear arrangement, an oval arrangement, a quadrilateral arrangement, and/or any other shaped arrangement that would be apparent to one of skill in the art in possession of the present disclosure. The each of the plurality of lights may be configured to independently activate and/or deactivate such that various visual indications may be provided by the visual indicator 512 by activating and deactivating particular lights.

The chassis 502 may also house a user input/output (I/O) system 514. The user I/O system 514 may be coupled to the visual indicator module 504 via the processing system. The user I/O system 514 may provide one or more input devices such as, for example, keyboards, touchscreens, pointing devices such as mouses, trackballs, and trackpads, a voice control system, and/or a variety of other input devices for an actor/operator to provide inputs to the visual indicator system 500 that would be apparent to one of skill in the art in possession of the present disclosure. The user I/O system 514 may include one or more output devices such as a haptic feedback device that is configured to provide sounds, vibrations, visualizations, and/or other tactile and/or haptic feedback known in the art.

The chassis 502 may also house a power supply system 516 that may include and/or be configured to couple to a battery. For example, the power supply system 516 may include an integrated rechargeable battery that may be recharged in the chassis 502 using methods known in the art, and/or may include other power sources that would be apparent to one of skill in the art in possession of the present disclosure. In some embodiments, a user device may be configured to couple to the chassis 502 (e.g., via a port system that includes a power port) that may provide for the recharging of a rechargeable battery included in the power supply system 516. In various embodiments, port systems may include a data port configured to communicate data between the visual indicator module 504 and the user device (e.g., via a cable or other connector.) In other embodiments, the power supply system 516 may be configured to accept a replaceable, non-rechargeable battery while remaining within the scope of the present disclosure as well. While visual indicator system 500 has been illustrated and described, one of skill in the art in possession of the present disclosure will recognize that the teachings of the present disclosure will be beneficial for a variety of visual indicator systems that would be apparent to one of skill in the art in possession of the present disclosure and, as such, a wide variety of modifications to the number, types, and orientation of devices and modules in the visual indicator system 500 will fall within the scope of the present disclosure as well.

Figure 6:
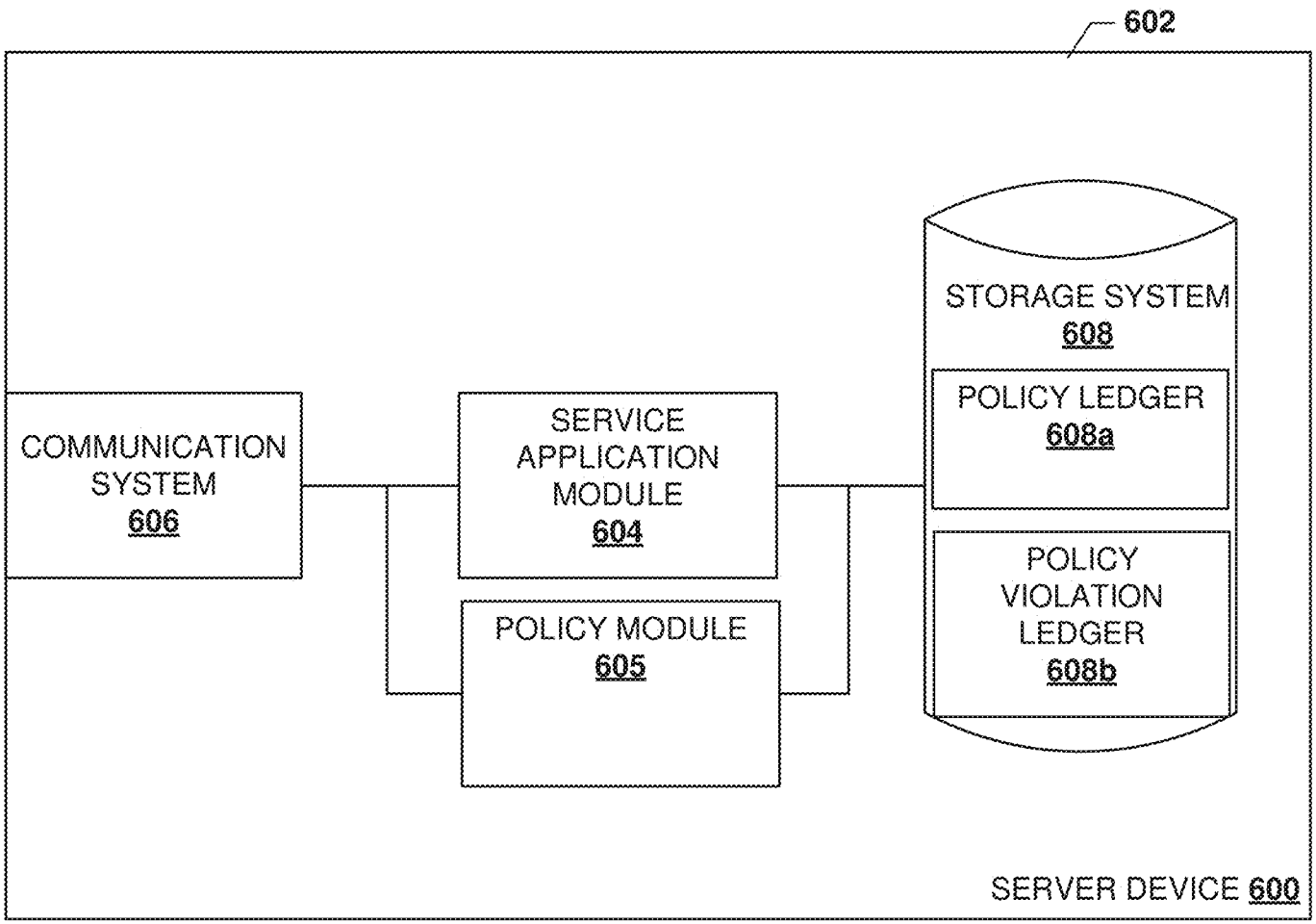
FIG. 6 is a schematic view illustrating an embodiment of a server device used in the autonomous vehicle signaling system of FIG. 1.

Referring now to FIG. 6, an embodiment of a server device 600 is illustrated that may be the server device 110 discussed above with reference to FIG. 1. In various embodiments, the server device 600 is a traffic management server device that provides traffic management in a physical environment 104, however other server device that provide other services are contemplated as well. In the illustrated embodiment, the server device 600 includes a chassis 602 that houses the components of the server device 600, only some of which are illustrated in FIG. 6. For example, the chassis 602 may house a processing system (not illustrated) and a non-transitory memory system (not illustrated) that includes instructions that, when executed by the processing system, cause the processing system to provide a service application module 604 and/or a policy module 605 that is configured to perform the functions of the service application module, the policy module, and/or server devices discussed below. In the specific example illustrated in FIG. 6, the service application module 604 is configured as a visual indicator application to provide visual indicator profiles that include visual indications associated with instructions, translations, and/or conditions to the autonomous vehicle 102*a*, the RSE units 108, and/or the visual indicator systems 120*a* and/or 120*b* associated with the actors 106*a* and/or 106*b* when those visual indicator systems 120*a* and/or 120*b* are coupled to the network 112. However, one of skill in the art in possession of the present disclosure will recognize that the service application module 604 and may provide any number of services from various service providers for autonomously navigating the autonomous vehicle 102*a*. In various embodiments, the policy module 605 may be configured to operate with the service application module 604 to record policy agreements with a policy ledger and/or enforce policy agreements established with users/actors within the physical environment 104, as well as other functionality discussed below.

The chassis 602 may further house a communication system 606 that is coupled to the service application module 604 (e.g., via a coupling between the communication system 606 and the processing system) and that is configured to provide for communication through the network 112 as detailed below. The communication system 606 may allow the server device 600 to send and receive information over the network 112 of FIG. 1. The chassis 602 may also house a storage device (not illustrated) that provides a storage system 608 (e.g., the traffic management database 118) that is coupled to the service application module 604 through the processing system. The storage system 608 may be configured to store authentication credentials, cryptographic keys and/or certificates used to authenticate communication within the traffic management system 100 and/or visual indicator profiles. The storage system 608 may also store a policy ledger 608*a* and/or a policy violation ledger 608*b*, which may be a complete copy and/or a portion of a policy ledger and/or policy violation ledger for the traffic management system 100. While a specific server device 600 has been illustrated and described, one of skill in the art in possession of the present disclosure will recognize that the teachings of the present disclosure will be beneficial for a variety of server devices that would be apparent to one of skill in the art in possession of the present disclosure and, as such, a wide variety of modifications to the number, types, and orientation of devices and modules in the server device 600 will fall within the scope of the present disclosure as well.

Figure 7:
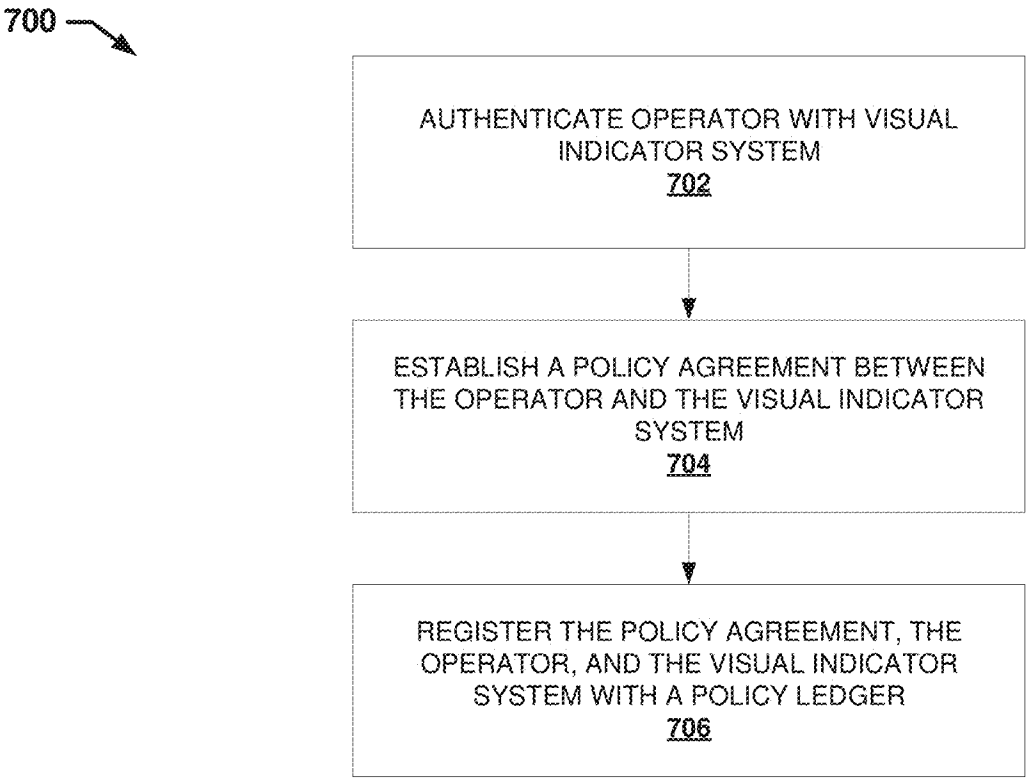
FIG. 7 is a flow chart illustrating an embodiment of a method of registering an operator with the traffic management system of FIG. 1.

Referring now to FIG. 7, an embodiment of a method 700 of registering an operator with the traffic management system is illustrated. The method 700 will be discussed in reference to the FIGS. above. The method 700 is described as being performed by the visual indicator system 120*c* that includes the autonomous vehicle 102*a*, the visual indicator system 120*d* that includes the RSE unit 108, the visual indicator system 120*a* associated with the actor 106*a* and/or the visual indicator system 120*b* associated with the actor 106*b*. The method 700 begins at block 702 where an operator is authenticated with a visual indicator system. In an embodiment of block 702 and from the perspective of the visual indicator system 120*a*, an operator that may include the actor 106*a* or the actor 106*b* (also described as a user herein) may desire to use the visual indicator system 120*a*. As discussed above, the visual indicator system 120*a* may be the visual indicator system 500 and as such include the chassis 502 that may include a wearable device such as, for example, a helmet, a shirt, an armband, a leg band, a vest, a shirt, a backpack, a pair of glasses, a shoe, a watch, a jacket (as illustrated as an example in FIG. 5), and/or any other wearable device that would be apparent to one of skill in the art in possession of the present disclosure and/or the chassis 502 may include a non-autonomous vehicle or a personal transportation vehicle (e.g., a bike, a scooter, rollerblades, a skateboard, a hoverboard, and/or any other personal transportation vehicle that would be apparent to one of skill in the art in possession of the present disclosure. While described from the perspective of the visual indicator system 120*a*, an operator may desire to use the autonomous automobile 102*a* or the non-autonomous vehicle 102*b*, and thus method 700 may be performed with that equipment as well.

In various embodiments, the operator (e.g., the actor 106*a*) may be authenticated at the visual indicator system 120*a*. The operator may provide credentials and/or otherwise log in to the visual indicator system 120*a* such that a user profile for that operator is associated with the visual indicator system 120*a*. In other examples, the operator may register and establish a user profile with the visual indicator system 120*a* and/or a service provider that provides services for the visual indicator system prior to the authentication or as part of an initial authentication process. The user profile may include information about the operator such as, for example, name, age, physical characteristics, address, payment information, user preferences, and/or any other user information that would be apparent to one of skill in the art in possession of the present disclosure.

In some examples, the operator may be authenticated for each use of the visual indicator system 120*a*. For example, the operator may decide to rent a visual indicator system that includes an electric scooter provided by a service provider. The operator may be authenticated using the user I/O system 514 and/or through a user device that communicates with the visual indicator system 120*a* directly via the communication system 506 or indirectly via a server device that provides the communication between the user device and the communication system 506 of the visual indicator system 120*a*.

In other examples, the operator may be authenticated once with the visual indicator system 120*a* and may remain authenticated/associated with the visual indicator system 120*a* until the operator logs out of the visual indicator system 120*a*. For example, the operator may register and be associated with an autonomous or non-autonomous vehicle when the user purchases the vehicle. In another example, the chassis 502 of visual indicator system 120*a* may include a vest for a family pet and the owner of the pet may register the visual indicator system 120*a* to be associated with the pet. While specific examples of an operator being authenticated with a visual indicator system are described, one of skill in the art in possession of the present disclosure will recognize that the operator may be authenticated/associated with various visual indicator systems by other authentications and/or associations methods without departing from the scope of the present disclosure.

The method 700 then proceeds to block 704 where a policy agreement is established between the actor and the visual indicator system. In an embodiment of block 704, a policy agreement may be established between the operator and the visual indicator system 120*a*. In various embodiments, the visual indicator system 120*a* may provide a policy agreement (e.g., an SLA) to the operator. For example, prior to, during, or subsequent to the authentication at block 704, the visual indicator system 120*a*, via the communication system 506 and/or the user I/O system 514, may present a policy agreement to the operator that includes specific rules, standards, laws, and/or other policies that operator may be required to abide by when using the visual indicator system 120*a*. For example, if the operator is renting an electric scooter, the policy agreement may include a condition that the user only rides on roadways and not on sidewalks, lawns, or other landscapes. Other conditions in the policy agreement may include that the user of the electric scooter follow traffic laws or maintain certain speeds. In situations where the operator lacks agency such as a small child, a pet, or a simple robot, the policy agreement may include less conditions as the operator may not have the agency or capacity to follow the conditions. Similarly, when the operator is someone with authority or special clearances such as, for example, a police officer, a firefighter, or a paramedic, the policy agreement for that operator with special clearance may be different when those individuals are acting under an official capacity. Nonetheless, when the policy agreement is accepted, the operator may be associated with the visual indicator system 120*a*.

In other examples, the policy agreement may be established for an operator to operate in a specific physical environment. For example, the RSE unit 108 may provide the policy agreement to the operator via a user device and/or the visual indicator system 120*a*. The policy agreement provided by the RSE unit 108 may include policies for the physical environment 104 in which the operator is an active participant (e.g., traffic of the physical environment 104). As such, the policy agreement may be for a specific geofence. While specific examples, of establishing policy agreements between a user and a service provider of a visual indicator system are discussed, one of skill in the art in possession of the present disclosure will recognize that various policy agreements and situations where policy agreements may be used will fall under the scope of the present disclosure.

The method 700 then proceeds to block 706 where the policy agreement is registered at a policy ledger. In an embodiment of block 706, the policy agreement may be provided to the traffic management database 118. In various embodiments, the policy ledger may be centralized at the traffic management database 118. However, in other embodiments, the policy ledger may include a distributed ledger that is distributed amongst the visual indicator systems 120*a*, 120*b*, 120*c*, and/or 120*d* within the physical environment 104 (e.g., the autonomous vehicle storage system 214, storage system 418, and/or the storage system 508). In some instances, the distributed policy ledger and policy enforcement ledger may be implemented as a blockchain system. Once, the operator establishes the policy agreement, the policy agreement may be added to the policy ledger. In an embodiment, the visual indicator system 120*a* may provide the policy agreement via the communication system 506 to the server device 110 that adds the policy agreement to the policy ledger 608*a* in the storage system 608 that may be a centralized policy ledger. However, in some embodiments the policy ledger 608*a* may be included in the distributed policy ledger. In other embodiments, the visual indicator system 120*a* may provide the policy agreement via its visual indicator 512. For example, the policy agreement may be encoded into visual indications (e.g., light signals) generated by the visual indicator 512. The visual indicator 512 may be configured to provide visual indications for machine-to-machine communications such as providing high frequency light pulses that are indistinguishable to the human eye but are detectable by sensor systems in the other visual indicator systems 120*b*, 120*c*, 120*d*. As such, the machine-to-machine communications can be encoded/interleaved into machine-to-human communications provided by the visual indicator 512. For example, a relatively long pulse of light as perceived by a human may comprise many short pulses of light that can be detected by a sensor system.

In various embodiments, the policy agreement may be added to the policy ledger. Also, other information may be added to the policy ledger and associated with the policy agreement. For example, an operator identifier for the operator (e.g., a name, a phone number, a personal identification identifier), a visual indicator system identifier for the visual indicator system 120*a* (e.g., a serial number, a Media Access Control (MAC) address, and/or any other machine identifier), and/or a policy identifier for the combination of the user/actor identifier and the visual indicator system identifier. In some examples, the policy identifier associated with the policy agreement may be a hash of the visual indicator system identifier and the operator identifier. In other embodiments, the information that is associated with the policy agreement may be a time at which the policy agreement was established. As such, the policy identifier may include a hash of the operator identifier, the visual indicator system identifier, and the time at which the policy agreement was established.

In various embodiments, a policy may change based on a change in the physical environment 104 (e.g. the traffic enters a new physical environment/geofence), a time of day, and/or by an update to a current policy. Policy changes may be communicated via the visual indicator systems 120*a*-120*d* that may take immediate effect upon receipt (e.g. slowing in school zones, removal of manual control for an autonomous actor if entering a high security zone, etc.).

Figure 8:
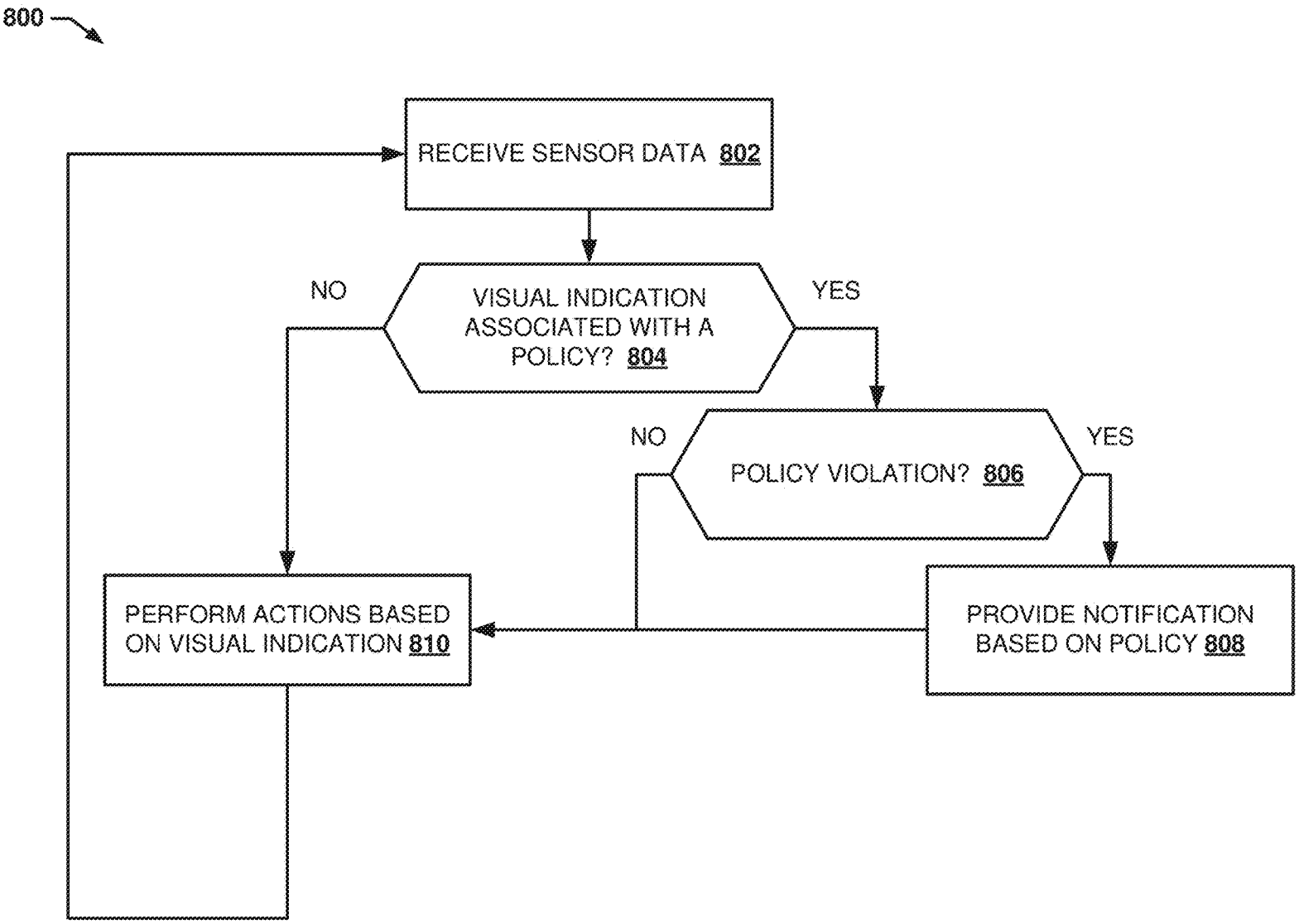
FIG. 8 is a flow chart illustrating an embodiment of a method for policy enforcement.

Referring now to FIG. 8, a method 800 of policy enforcement in traffic management system is illustrated. The method 800 begins at block 802 where sensor data is received. In an embodiment of block 802 and from the perspective of the visual indicator system 120*c* that includes the autonomous vehicle 102*a*, the sensor data may be generated by the sensor system 236 of the autonomous vehicle 102*a* and provided to the autonomous vehicle controller 204. In various embodiments, the sensor data may include autonomous vehicle data of the autonomous vehicle 200 and/or environmental data of the physical environment 104. The environmental data of the physical environment 104 may include traffic data of non-autonomous vehicle 102*b*, the actor 106*a*, the actor 106*b*, and/or RSE unit 108. The traffic data may further include visual indications provided by the visual indicator systems 120*a*, 120*b*, and/or 120*d* via the visual indicator 422 for the visual indicator system 120*d* and the visual indicator 512 for the visual indicator system 120*a* and/or 120*b* associated with actor 106*a* and 106*b*, respectively. The visual indications may be captured by the imaging sensor system 302 while other environment data and/or actor data may be captured by the radar system 306, the lidar system 308, and/or the motion detector 310.

In an embodiment of block 802 and from the perspective of the visual indicator system 120*a* associated with actor 106*a* and/or the visual indicator system 120*b* associated with actor 106*b*, the sensor data may be generated by the sensor system 510 of the visual indicator system 500 and provided to the visual indicator module 504. In various embodiments, the sensor data may include visual indicator system data of the visual indicator system 500. In other embodiments, the first sensor data may include environmental data of the physical environment 104. The environmental data of the physical environment 104 may include traffic data of the actor 106*b*, the autonomous vehicle 102*a*, the non-autonomous vehicle 102*b*, the RSE unit 108 and/or the 106*a* when the visual indicator system 500 is the visual indicator system 120*a*. The traffic data may further include visual indications provided by the visual indicator systems 120*a*, 120*b*, 120*c*, and/or 120*d* via the visual indicator 422 for the visual indicator system 120*d*, the visual indicator 512 for the visual indicator system 120*a* or 120*b* associated with actor 106*a* or 106*b*, respectively, or the visual indicator 240 of the autonomous vehicle 102*a* and provided according to the method 800 described herein. The environment data may be captured by an imaging sensor and/or light detector included in the sensor system 510.

In an embodiment of block 802 and from the perspective of the visual indicator system 120*c* of the RSE unit 108, the sensor data may be generated by the sensor system 420 of the RSE unit 108 and provided to the visual indicator module 408. In various embodiments, the sensor data may include RSE unit data of the RSE unit 400. In other embodiments, the sensor data may include environmental data of the physical environment 104. The environmental data of the physical environment 104 may include traffic data of the autonomous vehicle 102*a*, the non-autonomous vehicle 102*b*, the actor 106*a* and/or the actor 106*b*. The traffic data may further include visual indications provided by the visual indicator systems 120*a*, 120*b*, and/or 120*c* via the visual indicator 512 for the visual indicator system 120*a* associated with actor 106*a* and/or the visual indicator system 120*b* associated with the actor 106*b*, or the visual indicator 240 of the autonomous vehicle 102*a*. The environmental data may be captured by an imaging sensor included in the sensor system 420.

The method 800 may then proceed to decision block 804 where it is determined whether any visual indication included in the sensor data is associated with a policy. In an embodiment of decision block 804 and from the perspective of the visual indicator system 120*c* associated with the autonomous vehicle 102*a*, the autonomous vehicle controller 204 may determine whether a visual indication included in the sensor data is associated with a policy. For example, the visual indicator systems 120*a*, 120*b*, and/or 120*d* may provide a visual indication that may include a visual indication for machine-to-human communication, machine-to-machine communication, or a combination of both. For example, a machine-to-human communication may include an embedded machine-to-machine communication, as discussed above. As such, the visual indication may include the policy identifier as discussed above for the visual indicator system from which the visual indication was received. The policy module 326 may process the policy identifier and determine whether the policy identifier is associated with a policy stored in a policy ledger stored in the autonomous vehicle storage system 214. For example, the policy module 326 may compare the policy identifier provided in the visual indication to policy identifiers associated with policy agreements stored in the autonomous vehicle storage system 214.

In an embodiment of decision block 804 and from the perspective of the visual indicator system 120*a* associated with actor 106*a* and/or the visual indicator system 120*b* associated with actor 106*b*, the policy module 505 in conjunction with the visual indicator module 504 may determine whether a visual indication included in the sensor data is associated with a policy. For example, the visual indicator systems 120*a*, 120*b*, 120*c*, and/or 120*d* may provide a visual indication that may include a visual indication for machine-to-human communication, machine-to-machine communication, or a combination of both. For example, a machine-to-human communication may include an embedded machine-to-machine communication, as discussed above. As such, the visual indication may include the policy identifier as discussed above for the visual indicator system from which the visual indication was received. The policy module 505 of the visual indicator system 120*a* and/or 120*b* may process the policy identifier and determine whether the policy identifier is associated with a policy stored in the policy ledger 508*a* stored in the storage system 508. For example, the policy module 505 may compare the policy identifier provided in the visual indication to policy identifiers associated with policy agreements stored in the policy ledger 508*a*.

In an embodiment of decision block 804 and from the perspective of the visual indicator system 120*d* associated with RSE unit 108, the policy module 409 in conjunction with the visual indicator module 408 may determine whether a visual indication included in the sensor data is associated with a policy. For example, the visual indicator systems 120*a*, 120*b*, and/or 120*c* may provide a visual indication that may include a visual indication for machine-to-human communication, machine-to-machine communication, or a combination of both. For example, a machine-to-human communication may include an embedded machine-to-machine communication, as discussed above. As such, the visual indication may include the policy identifier as discussed above for the visual indicator system from which the visual indication was received. The policy module 409 of the visual indicator system 120*d* may process the policy identifier and determine whether the policy identifier is associated with a policy stored in the policy ledger 418*a* stored in the storage system 418. For example, the policy module 409 may compare the policy identifier provided in the visual indication to policy identifiers associated with policy agreements stored in the policy ledger 418*a*.

In an embodiment of decision block 804 and from the perspective of the server device 110, the policy module 605 may determine whether a visual indication included in the sensor data is associated with a policy. For example, the visual indicator systems 120*a*, 120*b*, 120*c*, and/or 120*d* may provide any visual indication received from the physical environment 104 to the server device 110 via the network 112. The visual indication that may include a visual indication for machine-to-human communication, machine-to-machine communication, or a combination of both. For example, a machine-to-human communication may include an embedded machine-to-machine communication, as discussed above. As such, the visual indication may include the policy identifier as discussed above for the visual indicator system from which the visual indication was received. The policy module 605 of the server device 110 may process the policy identifier and determine whether the policy identifier is associated with a policy stored in the policy ledger 608*a* stored in the storage system 608. For example, the policy module 605 may compare the policy identifier provided in the visual indication to policy identifiers associated with policy agreements stored in the policy ledger 608*a*.

If the visual indication is associated with a policy agreement, then the method 800 may proceed to decision block 806 where it is determined whether the visual indicator system associated with the policy agreement is violating a policy. In an embodiment of decision block 806, the policy module 326, 409, 505, and/or 605 may process the sensor data received by the sensor system 300, 420, and/or 510 from the physical environment 104 to determine whether a policy of the policy agreement has been violated. For example, the sensor data may indicate that the operator of the visual indicator system 120*a*, 120*b*, 120*c*, and/or 120*d* is violating a policy of obeying traffic laws. For example, the autonomous vehicle 102*a* may be proceeding at a speed that is too fast for a speed limit set in for the physical environment 104. In other examples, the operator of the of the visual indicator system 120*a*, 120*b*, 120*c*, and/or 120*d* may be operating the visual indicator system in violation of a use policy set by the service provider of the visual indicator system. For example, a visual indicator system that includes a rented electric scooter may be operated by the operator in such a way that the service provider of the electric scooter prohibits. In other examples, the visual indicator system 120*a*, 120*b*, 120*c*, and/or 120*d* may violate a pollution policy or a social norm policy (e.g., merging too soon, cutting off other vehicles) that is expected of the visual indicator system 120*a*, 120*b*, 120*c*, and/or 120*d*.

If at decision block 806 it is determined that a policy of the policy agreement has been violated, the method 800 proceeds to block 808 where a notification is provided based on the violated policy. In an embodiment of block 808, the policy module 326, 409, 505, and/or 605 may provide a notification to the policy violation ledger (e.g., the policy violation ledger 418*b*, 508*b*, and/or 608*b*) that include the policy violation. As such, the policy violation may be recorded on the policy violation ledger 418*b*, 508*b*, and/or any policy violation ledger stored in the autonomous vehicle storage system 214, which may be a distributed policy violation ledger that is distributed between the visual indicator systems 120*a*-120*d* in the physical environment 104. In other examples, the policy violation may be recorded in the policy violation ledger 608*b* included in the storage system 608, which may be a part of the distributed policy violation ledger or a centralized policy violation ledger. The policy violation may include the date and time of the violation, the violation, the operator, and/or any other sensor data or metadata that would be apparent to one of skill in the art in possession of the present disclosure.

In various embodiments, a policy violation notification may be communicated from the visual indicator system or other monitoring device that detected the policy violation via the network 112, its visual indicator, and/or through a direct communication to an enforcement device. The policy violation notification may include the violation, the penalty associated with the violation, any instructions associated with the violation, and/or any other information that would be apparent to one of skill in the art in possession of the present disclosure. In an example, the non-autonomous vehicle may 102*b* may be a police vehicle or the RSE unit 108 may be a gate, a traffic light, or other enforcement device that may regulate the operator and/or the associated visual indicator system within the physical environment, issue fines, and/or other enforcement procedures that would be apparent to one of skill in the art in possession of the present disclosure. In other examples, the enforcement device may be the server device 110. The server device 110 may generate a penalty for the violating visual indicator system and/or operator for violating the policy. For example, the policy module 605 may issue a fine, prohibit use, issue a warning, and/or any other penalty for violating the policy. Each policy within the policy agreement may have a different penalty associated with the policy.

In various embodiments, the policy violation may be communicated from the policy module 326, 409, 505, and/or 605 that detected the policy violation via the network 112, its visual indicator, and/or through a direct communication to the visual indicator system that is violating the policy. For example, the visual indicator system 120*d* may provide a policy violation notification to the visual indicator system 120*a* that the visual indicator system 120*a* is violating a policy. The policy violation notification may include the violation, the penalty associated with the violation, any instructions associated with the violation, and/or any other information that would be apparent to one of skill in the art in possession of the present disclosure. The instructions may cause the visual indicator system 120*a* that is violating the policy to perform an action such as correct its violating functionality and/or provide a violation notification via the user I/O system 514 to notify or warn the operator of the violated policy. From the perspective of the visual indicator system 120*d*, the violation notification may be provided to the operator via the user interface system 218.

In another embodiment, the distribution of a notification for a violation may affect the visual indicator systems 120*a*-120 such that new visuals are displayed. For example, if the RSE unit 108 provides a visual indication on the visual indicator system 120*d* as a speed limiter, but the autonomous vehicle car 102*a* runs a light and hits the actor 106*a*, the visual indicator system 120*d* can provide visual indicator that represents a stop signal, or some other informative signal to indicate alternate routes or estimated delay time, which may in turn trigger different actor choices (e.g. reroute navigation, alter speed, request manual intervention, etc).

The method 800 may proceed to block 810 after block 808, in response to the visual indication not being associated with a policy in decision block 804, or in response to a violation not being detected in decision block 806 where actions may be performed according to the visual indication received as disclosed in U.S. patent application Ser. No. 16,399,086, filed on Apr. 30, 2019, and directed to autonomous vehicle signal system, which is incorporated by reference herein in its entirety. At block 810, an action is performed based on visual indications in the sensor data. In an embodiment of block 810 and from the perspective of the visual indicator system 120*c* of the autonomous vehicle 102*a*, the autonomous vehicle controller 204 may process any visual indications received in the sensor data to determine whether the visual indication corresponds with an action. Thus, block 810 may be performed any time after block 802. For example, a visual indication received by the sensor system 236 from the visual indicator system 120*b* associated with the actor 106*b* may indicate an acceleration of the actor 106*b*. The autonomous vehicle controller 204 may use the visual indication in addition to other sensor data to determine an action for the autonomous vehicle 102*a* other than the traffic management functions discussed above. For example, the acceleration of the actor 106*b* indicated by the visual indication, the distance between the autonomous vehicle 102*a* and the actor 106*b*, and the current speed of the autonomous vehicle 102 may cause the autonomous vehicle controller 204 to determine that the braking system 232 needs to engage brakes to slow the autonomous vehicle 102*a* to avoid colliding with the actor 106*b* and performs this action. As discussed above, the braking of the autonomous vehicle 102*a* (e.g., deceleration) may correspond with a visual indication that autonomous vehicle 102*a* provides via the visual indicator 240 as well. As such, the autonomous vehicle 102*a* may communicate via the visual indicator system 242 in lieu of or in addition to formal vehicle-to-vehicle communication networks.

In an embodiment of block 810 and from the perspective of the visual indicator system 120*a* and/or 120*b*, the visual indicator system 500 may process any visual indications received in the sensor data to determine whether the visual indication corresponds with an action. The visual indicator module 504 may use the visual indication in addition to other sensor data provided by the sensor system 510 to determine an action for the visual indicator system 120*a* and/or 120*b*. For example, a visual indication received by the sensor system 510 of the visual indicator system 120*b* associated with actor 106*b* from the visual indicator system 120*c* associated with the autonomous vehicle 102*a* may indicate an acceleration of the autonomous vehicle 102*a*. The actor 106*b* may also be accelerating toward the street and thus the sensor system 510 may detect the acceleration of the actor 106*b*, the acceleration of the autonomous vehicle via the visual indication received, and/or other sensor data. Based on the visual indication provided by the autonomous vehicle, the visual indicator module 504 may determine to provide a warning to the actor 106*b* to stop via the user I/O system 514. For example, an audio warning to stop may be provided by the user I/O system 514 and/or a haptic feedback may be provided by the user I/O system 514 to alert the actor 106*b* when the visual indicator system 120*b* is incorporated into a wearable device. For example, a jacket may have a haptic feedback device incorporated into the chest area of the jacket that applies pressure to the chest of an actor 106*a* indicating to the actor 106*b* to stop.

In an embodiment of block 810 and from the perspective of the visual indicator system 120*d*, the visual indicator module 408 of the RSE unit 400 may process any visual indications received in the sensor data to determine whether the visual indication corresponds with an action and perform that action. The visual indicator module 408 may use the visual indication in addition to other sensor data provided by the sensor system 420 to determine an action for the RSE unit 108. For example, a visual indication received by the sensor system 420 of the visual indicator system 120*d* associated with RSE unit 108 from the visual indicator system 120*c* associated with the autonomous vehicle 102*a* may indicate an acceleration of the autonomous vehicle 102*a* and that the autonomous vehicle 102*a* is an emergency vehicle. The RSE unit 108 may include a gate that is down. The visual indication received from the autonomous vehicle 102*a* along with any other sensor data may cause the RSE application module 406 to lift the gate so that the autonomous vehicle 102*a* can proceed along its route. As discussed above, the lifting of gate may correspond with a visual indication that RSE unit 108 provides via the visual indicator 422 as well.

After block 810, the method 800 may then loop back to block 802 to receive additional sensor data. As such, the policy module 326, 409, 505, and/or 605 that detected the policy violation may receive additional sensor data to determine whether the violating visual indicator system is now in compliance. However, in other embodiments the method 800 may skip decision block 804 in subsequent cycles. Thus, the policy module 326, 409, 505, and/or 605 that detected the policy violation may request additional sensor data from the violating visual indicator system as well. In other various embodiment, the policy modules 326, 409, 505, and/or 605, the sensor systems that supply the sensor data within the physical environment may be rewarded for providing the sensor data and/or determining the policy violation.

Figure 9:
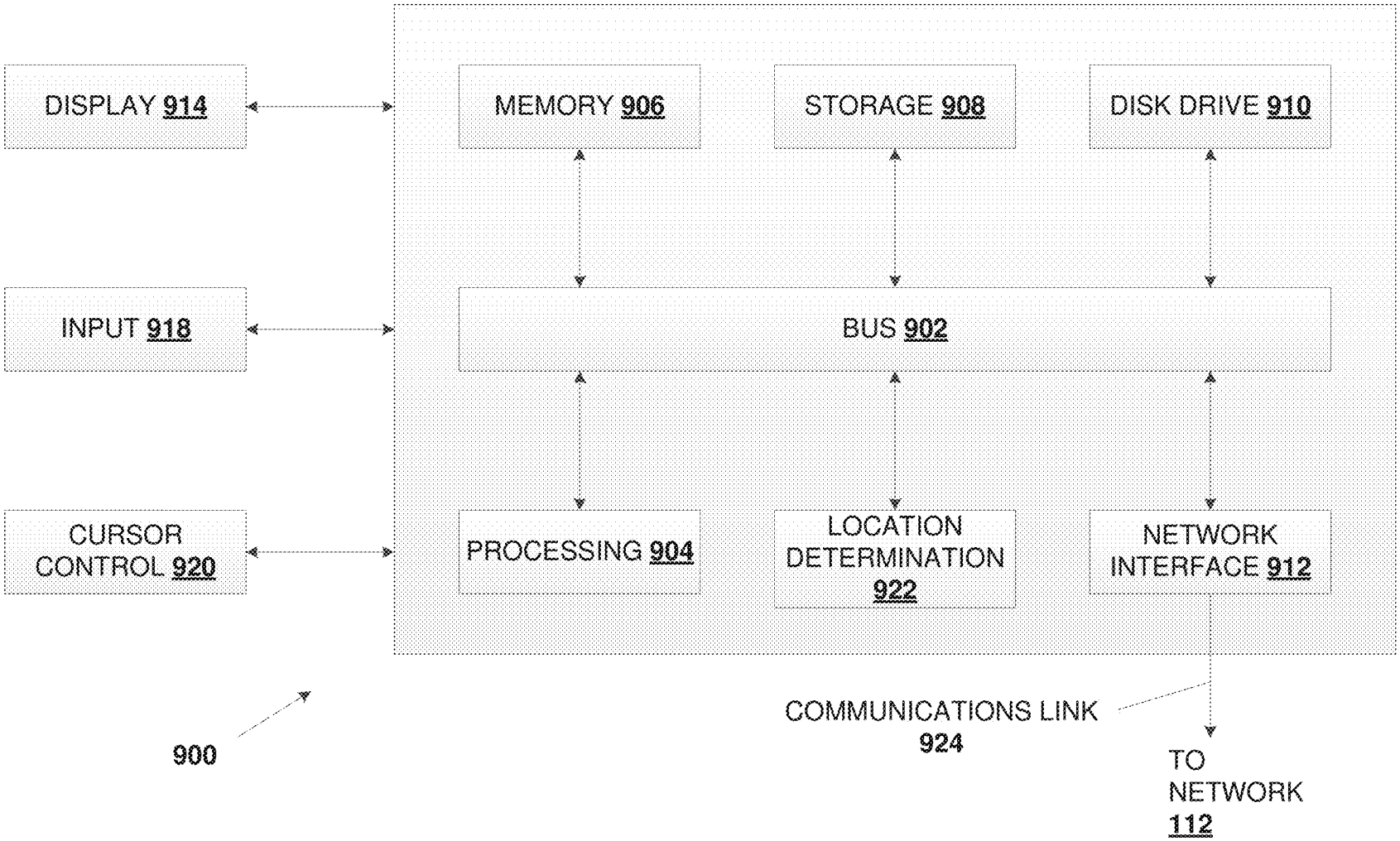
FIG. 9 is a schematic view illustrating an embodiment of a computer system.

Referring now to FIG. 9, an embodiment of a computer system 900 suitable for implementing, for example, visual indicator systems 120*a*-120*d* and 500, the RSE unit 108 and 400 and the server devices 110 and 600 and implementing in the autonomous vehicle 102*a* and 200 is illustrated. It should be appreciated that other devices utilized in the traffic management system 100 discussed above may be implemented as the computer system 900 in a manner as follows.

In accordance with various embodiments of the present disclosure, computer system 900, such as a computer and/or a network server, includes a bus 902 or other communication mechanism for communicating information, which interconnects subsystems and components, such as a processing component 904 (e.g., processor, micro-controller, digital signal processor (DSP), etc.), a system memory component 906 (e.g., RAM), a static storage component 908 (e.g., ROM), a disk drive component 910 (e.g., magnetic or optical), a network interface component 912 (e.g., modem or Ethernet card), a display component 914 (e.g., CRT or LCD), an input component 918 (e.g., keyboard, keypad, or virtual keyboard), a cursor control component 920 (e.g., mouse, pointer, or trackball), and/or a location determination component 922 (e.g., a Global Positioning System (GPS) device as illustrated, a cell tower triangulation device, and/or a variety of other location determination devices.) In one implementation, the disk drive component 910 may comprise a database having one or more disk drive components.

In accordance with embodiments of the present disclosure, the computer system 900 performs specific operations by the processing component 904 executing one or more sequences of instructions contained in the system memory component 906, such as described herein with respect to the drone(s), the drone docking station(s), the service platform, and/or the remote monitor(s). Such instructions may be read into the system memory component 906 from another computer-readable medium, such as the static storage component 908 or the disk drive component 910. In other embodiments, hardwired circuitry may be used in place of or in combination with software instructions to implement the present disclosure.

Logic may be encoded in a computer-readable medium, which may refer to any medium that participates in providing instructions to the processing component 904 for execution. Such a medium may take many forms, including but not limited to, non-volatile media, volatile media, and tangible media employed incident to a transmission. In various embodiments, the computer-readable medium is non-transitory. In various implementations, non-volatile media includes optical or magnetic disks and flash memory, such as the disk drive component 910, volatile media includes dynamic memory, such as the system memory component 906, and tangible media employed incident to a transmission includes coaxial cables, copper wire, and fiber optics, including wires that comprise the bus 902 together with buffer and driver circuits incident thereto.

Some common forms of computer-readable media include, for example, floppy disk, flexible disk, hard disk, magnetic tape, any other magnetic medium, CD-ROM, DVD-ROM, any other optical medium, any other physical medium with patterns of holes, RAM, PROM, EPROM, FLASH-EPROM, any other memory chip or cartridge, cloud storage, or any other medium from which a computer is adapted to read. In various embodiments, the computer-readable media are non-transitory.

In various embodiments of the present disclosure, execution of instruction sequences to practice the present disclosure may be performed by the computer system 900. In various other embodiments of the present disclosure, a plurality of the computer systems 900 coupled by a communication link 924 to the network 112 (e.g., such as a LAN, WLAN, PTSN, and/or various other wired or wireless networks, including telecommunications, mobile, and cellular phone networks) may perform instruction sequences to practice the present disclosure in coordination with one another.

The computer system 900 may transmit and receive messages, data, information and instructions, including one or more programs (e.g., application code) through the communication link 924 and the network interface component 912. The network interface component 912 may include an antenna, either separate or integrated, to enable transmission and reception via the communication link 924. Received program code may be executed by processor 904 as received and/or stored in disk drive component 910 or some other non-volatile storage component for execution.

Where applicable, various embodiments provided by the present disclosure may be implemented using hardware, software, or combinations of hardware and software. Also, where applicable, the various hardware components and/or software components set forth herein may be combined into composite components comprising software, hardware, and/or both without departing from the scope of the present disclosure. Where applicable, the various hardware components and/or software components set forth herein may be separated into sub-components comprising software, hardware, or both without departing from the scope of the present disclosure. In addition, where applicable, it is contemplated that software components may be implemented as hardware components, and vice versa.

Software, in accordance with the present disclosure, such as program code or data, may be stored on one or more computer-readable media. It is also contemplated that software identified herein may be implemented using one or more general-purpose or special-purpose computers and/or computer systems, networked and/or otherwise. Where applicable, the ordering of various steps described herein may be changed, combined into composite steps, and/or separated into sub-steps to provide features described herein.

The foregoing is not intended to limit the present disclosure to the precise forms or particular fields of use disclosed. As such, it is contemplated that various alternate embodiments and/or modifications to the present disclosure, whether explicitly described or implied herein, are possible. Persons of ordinary skill in the art in possession of the present disclosure will recognize that changes may be made in form and detail without departing from the scope of what is claimed.

What is claimed is:

1. A method of management of traffic, comprising receiving, by equipment comprising a processor, first sensor data from traffic equipment located in a physical environment;

based on the first sensor data, determining, by the equipment, a presence of a first visual indication in the first sensor data, wherein the first visual indication comprises light pulses, wherein the light pulses are indistinguishable to a human eye, and wherein the light pulses communicate machine-to-machine data representing that a violation of a first policy agreement has occurred and machine-to-human data representing that the violation of the first policy agreement has occurred;

determining, by the equipment, that the first visual indication is associated with the first policy agreement; and based on the first sensor data, determining, by the equipment, that a first visual indicator system that provided the first visual indication is violating a first policy included in the first policy agreement and, in response, providing a policy violation notification that the first visual indicator system is violating the first policy.

2. The method of claim 1, wherein the first visual indication is provided by at least a portion of a first visual indictor associated with the first visual indicator system.

3. The method of claim 1, wherein providing the policy violation notification that the first visual indicator system is violating the first policy agreement comprises providing the policy violation notification to the first visual indicator system.

4. The method of claim 3, wherein the policy violation notification comprises first instructions to cause the first visual indicator system to perform an action to comply with the first policy.

5. The method of claim 3, wherein the policy violation notification causes the first visual indicator system to provide the policy violation notification to an operator of the first visual indicator system via a user interface.

6. The method of claim 1, wherein providing the policy violation notification that the first visual indicator system is violating the first policy agreement comprises providing the policy violation notification to an enforcement device.

7. The method of claim 1, further comprising:

determining, by the equipment, a first policy identifier in the first visual indication.

8. The method of claim 7, further comprising: determining, by the equipment, that the first policy identifier in the first visual indication is associated with a stored policy identifier associated with the first policy agreement.

9. The method of claim 7, wherein the first policy identifier is provided as a secondary visual indication embedded in the first visual indication.

10. The method of claim 7, wherein the first policy identifier is a hash of an operator identifier and a first visual indicator system identifier.

11. The method of claim 7, wherein the first policy identifier is a hash of an operator identifier, a first visual indicator system identifier, and a time at which a policy agreement was established.

12. The method of claim 1, further comprising:

registering, by the equipment, an association of the first policy agreement, an operator, and the first visual indicator system in a policy ledger.

13. The method of claim 1, further comprising:

receiving, by the equipment, second sensor data subsequent to the policy violation notification that the first visual indicator system is violating the first policy; and determining, by the equipment, that the first visual indicator system is in compliance with the first policy.

14. The method of claim 1, further comprising:

based on the policy violation notification, adding, by the equipment, a violation entry of the first policy to a policy violation ledger.

15. The method of claim 1, further comprising:

authenticating, by the equipment, a second operator with a second visual indicator system;

establishing, by the equipment, a second policy agreement between the second operator and the second visual indicator system; and registering, by the equipment, the second policy agreement, the second operator, and the second visual indicator system with a policy ledger.

16. The method of claim 15, wherein the policy ledger is distributed between the second visual indicator system and the second visual indicator system.

17. Traffic management equipment, comprising:

a processor; and a memory that stores executable instructions that, when executed by the processor, facilitate performance of operations, comprising:

receiving sensor data from traffic equipment located within a physical environment;

based on the sensor data, determining a visual indication in the sensor data, wherein the visual indication comprises pulses of light, wherein the pulses of light are imperceptible to human vision, and wherein the pulses of light communicate machine-to-machine data representing that a violation of a policy agreement has occurred and machine-to-human data representing that the violation of the policy agreement has occurred;

determining that the visual indication is associated with the policy agreement; and determining, based on the sensor data, that a first visual indicator system that provided the first visual indication is violating a policy included in the policy agreement and, in response, providing a policy violation notification that the visual indicator system is violating the policy.

18. A non-transitory machine-readable medium comprising executable instructions that, when executed by a processor, facilitate performance of operations comprising:

receiving sensor data from traffic equipment situated within a physical environment;

based on the sensor data, determining a visual indication in the sensor data, wherein the visual indication comprises high frequency light pulses, wherein the pulses are indistinguishable to a human eye, and wherein the high frequency light pulses communicate machine-to-machine data representing that a violation of a policy agreement has occurred and machine-to-human data representing that the violation of the policy agreement has occurred;

determining that the visual indication is associated with the policy agreement; and determining, based on the sensor data, that a visual indicator system that provided the visual indication is violating a policy included in the policy agreement and, in response, providing a policy violation notification that the visual indicator system is violating the policy.

19. The traffic management equipment of claim 17, wherein the operations further comprise receiving an electronic reward for the providing of the policy violation notification.

20. The non-transitory machine-readable medium of claim 18, wherein the operations further comprise:

performing an action based on the first visual indication.

* * * * *